US008596193B2

(12) United States Patent
Sakamoto et al.

(10) Patent No.: US 8,596,193 B2
(45) Date of Patent: Dec. 3, 2013

(54) GRAIN HULLER

(75) Inventors: Akinori Sakamoto, Osaka (JP); Tomohiro Mitsuhata, Osaka (JP); Koji Yokota, Osaka (JP); Tadashi Hamaguchi, Okayama (JP)

(73) Assignee: Yanmar Co., Ltd., Osaka-shi, Osaka (JP)

( * ) Notice: Subject to any disclaimer, the term of this patent is extended or adjusted under 35 U.S.C. 154(b) by 369 days.

(21) Appl. No.: 12/922,223

(22) PCT Filed: Jul. 2, 2008

(86) PCT No.: PCT/JP2008/061946

§ 371 (c)(1),
(2), (4) Date: Nov. 17, 2010

(87) PCT Pub. No.: WO2009/113189

PCT Pub. Date: Sep. 17, 2009

(65) Prior Publication Data

US 2011/0192291 A1 Aug. 11, 2011

(30) Foreign Application Priority Data

Mar. 14, 2008 (JP) ..... 2008-065738

(51) Int. Cl.
*B02B 3/04* (2006.01)

(52) U.S. Cl.
USPC ..... 99/617; 99/581; 99/584; 99/623

(58) Field of Classification Search
USPC ..... 99/484, 488, 516, 518–526, 428, 99/600–624, 626, 629, 634, 581–585; 451/312, 319
See application file for complete search history.

(56) References Cited

U.S. PATENT DOCUMENTS 3,952,645 A * 4/1976 Satake ..... 99/524
4,357,864 A * 11/1982 Salete-Garces ..... 99/484

(Continued)

FOREIGN PATENT DOCUMENTS

JP 56-28601 3/1981
JP 05-337382 12/1993

(Continued)

OTHER PUBLICATIONS

International Search Report for International Appln. No. PCT/JP2008/061946, Japanese Patent Office, mailed on Oct. 7, 2008, 7 pages.

(Continued)

*Primary Examiner* — Jianying Atkisson
(74) *Attorney, Agent, or Firm* — Sterne, Kessler, Goldstein & Fox P.L.L.C.

(57) ABSTRACT

A supply plate has a proximal end supported by a pivot shaft disposed parallel to a position-fixed shaft and a position-movable shaft. A position-movable shaft support member is pressed toward the position-fixed shaft so the first and second rolls are pressed at the contact point under a predetermined pressure. A link arm supported by a fulcrum shaft is pressed to a surface of the position-movable support member that faces the position-fixed shaft. The fulcrum shaft and the pivot shaft are connected. The contact point is shifted as the position-movable shaft support member moves toward the position-fixed shaft, and the pivot shaft is rotated around the axis line by the link arm, the fulcrum shaft, and the link mechanism based on the movement of the position-movable shaft support member, so the slant angle of the supply plate is automatically changed and the supply plate is directed to the contact point.

6 Claims, 16 Drawing Sheets

(56) References Cited

U.S. PATENT DOCUMENTS

| | | | | |
|---|---|---|---|---|
| 5,678,477 | A * | 10/1997 | Satake et al. | 99/519 |
| 2004/0261635 | A1 | 12/2004 | Gorlitz et al. | |

FOREIGN PATENT DOCUMENTS

| | | |
|---|---|---|
| JP | 07-222932 | 8/1995 |
| JP | 09-122510 | 5/1997 |
| JP | 09-313959 | 12/1997 |

OTHER PUBLICATIONS

The English Translation of the Written Opinion of the International Preliminary Report on Patentability for International Application No. PCT/JP2008/061946, The International Bureau of WIPO, mailed on Nov. 11, 2010, 8 pages.

* cited by examiner

GRAIN HULLER

FIELD OF THE INVENTION

The present invention relates to a grain huller that removes chaff of grain that has been threshed.

BACKGROUND ART

There has been conventionally known a grain huller including a pair of rolls that are disposed so as to be brought into pressure contact with each other, a grain tank and a hopper that are disposed above the pair of rolls. In this grain huller, grain contained in the grain tank is supplied to a portion between the pair of rolls by way of the hopper, and the pair of rolls rotate to remove chaff of the grain that is sandwiched between the pair of rotating rolls.

In such a grain huller, repetition of hulling operation causes abrasion of surfaces (such as rubber surfaces) of the pair of rolls so that outer diameters thereof decrease, which results in decrease of the pressure contact force between the pair of rolls.

In view of the above problem, there has been known a configuration in which one of a pair of roll shafts for respectively supporting the pair of rolls is made movable and this position-movable shaft is moved so as to adjust the distance between the axes of the pair of roll shafts (see, for example, Patent Document 1 that is mentioned below).

However, in the case where the position of the position-movable shaft is adjusted in accordance with degrees of abrasion of the pair of rolls, also displaced is the position of contact between the pair of rolls. In this case, the position of grain to be supplied from the grain tank by way of the hopper is displaced from the position of contact between the pair of rolls, resulting in deterioration in efficiency of hulling operation.

In order to solve this problem, there has been proposed the following configuration.

For excellent hulling outcome, it is important to supply, uniformly and regularly as much as possible, grain from the hopper to the portion between the pair of rolls. In other words, what is important is to supply grain, which has flown downward through the hopper, precisely to the position of contact between the pair of rolls.

For example, Patent Document 1 proposes a configuration in which a supply plate is provided between the hopper and the pair of rolls and the position of the supply plate is manually adjustable so as to direct a distal end of the supply plate to the position of contact between the pair of rolls.

In the grain huller described in Patent Document 1, adjustment of the position of the supply plate in accordance with degrees of abrasion of the pair of rolls makes it possible to supply grain from the grain tank by way of the hopper precisely to the position of contact between the pair of rolls. However, in this grain huller, the position of the supply plate needs to be manually adjusted, which requires troublesome work for positional adjustment of the supply plate. In addition, the grain huller of Patent Document 2 needs to stop hulling operation during the positional adjustment of the supply plate, which causes deterioration in efficiency of hulling operation.

To the contrary, Patent Document 2, which is mentioned below, discloses a configuration in which the position of the supply plate disposed between the hopper and the pair of rolls is automatically adjustable.

More specifically, the grain huller described in Patent Document 2 includes a sensor that electrically detects the outer diameter of one of the pair of rolls, and the position (slant angle) of the supply plate is controlled in accordance with the diameter of the roll to be detected by the sensor.

While being free from the above problems arising in the grain huller of Patent Document 1, the grain huller described in Patent Document 2 requires the sensor as well as a controller for controlling the position of the supply plate based on an electrical signal transmitted from the sensor, resulting in increase of the number of components and complexity in configuration of the apparatus.

Moreover, in the configuration described in Patent Document 2, in a case where deterioration or the like due to repeated use causes undulation of the outer surfaces of the pair of rolls, the sensor erroneously detects the size of the undulated shape as the outer diameter of the roll, which may result in failure in stable control of the position of the supply plate.

[Prior Document 1]

Japanese Patent Application Laid-open No. S56-28601

[Prior Document 2]

Japanese Patent Application Laid-open No. H9-313959

DISCLOSURE OF THE INVENTION

The present invention has been achieved in view of the above conventional arts, and it is an object thereof to provide a grain huller that includes a supply plate for guiding grain to a position of contact between a pair of rolls, wherein the grain huller is capable of easily and stably shifting the supply plate so as to follow the position of contact between the pair of rolls, which is displaced in accordance with degrees of abrasion of the pair of rolls.

In order to achieve the object, the present invention provides a grain huller including a position-fixed shaft, a position-movable shaft, a position-movable shaft support member, a first roll, a second roll, a pressing mechanism, a pivot shaft, and a supply plate. The position-fixed shaft is rotated around an axis line thereof by rotational power from a driving power source. The position-movable shaft is disposed substantially parallel to the position-fixed shaft and is rotated around an axis line thereof by rotational power from the driving power source. The position-movable shaft support member supports the position-movable shaft in a rotatable manner around the axis line and is capable of being come closer to and spaced away from the position-fixed shaft. The first roll is supported by the position-fixed shaft in a relatively non-rotatable manner with respect thereto. The second roll is supported by the position-movable shaft in a relatively non-rotatable manner with respect thereto. The pressing mechanism presses the position-movable shaft support member so that the first and second rolls are pressed to each other at a contact point by a predetermined pressure. The pivot shaft is disposed above and in parallel with the position-fixed shaft and the position-movable shaft. The supply plate has a proximal end portion supported by the pivot shaft in a relatively non-rotatable manner with respect thereto and a proximal end portion directed to the contact point so that material grain, which has been fed from above, is naturally flown downward toward the contact point.

The grain huller according to the present invention further includes a link structure that rotates the pivot shaft around the axis line with use of a movement of the position-movable shaft support member to be brought closer to the position-fixed shaft so that the distal end portion of the supply plate is rotated around the pivot shaft in a direction toward the position-fixed shaft in accordance with an amount of the movement of the position-movable shaft support member.

In the grain huller, the first and second rolls are constantly pressed to each other at the contact point with the predetermined pressure by pressing force of the pressing mechanism. In the configuration, if the first roll and/or the second roll are/is abraded, the position-movable shaft support member is pressed by the pressing mechanism in a direction toward the position-fixed shaft. Therefore, even if the first roll and/or the second roll are/is abraded, a contact condition in which the first and second rolls are pressed to each other under the predetermined pressure is kept.

However, the position of the contact point is changed in accordance with degree of abrasion of the first roll and/or the second roll. More specifically, the contact point is shifted from an initial position (a position of the contact point before the first and second rolls are abraded) toward the position-fixed shaft as the first roll and/or the second roll are/is abraded.

The grain huller according to the present invention makes it possible to automatically change a slant posture of the supply plate in accordance with degree of the abrasion of the first roll and/or the second roll so that the distal end portion of the supply plate is constantly directed to the contact point regardless degree of the abrasion of the first roll and/or the second roll.

More specifically, a position of the pivot shaft around the axis line thereof is set in an initial state before the first roll and/or the second roll are/is abraded so that the distal end portion of the supply plate is directed to the position (initial position) of the contact point in the initial state.

The first roll and/or the second roll are/is abraded in comparison with the initial state, the position-movable shaft support member is moved in a direction toward the position-fixed shaft by the pressing mechanism so that the contact point is also shifted in the direction toward the position-fixed shaft from the initial position. At this time, the link structure rotates the pivot shaft around the axis line so that the distal end portion of the supply plate is rotated around the pivot shaft in a direction toward the position-fixed shaft in accordance with amount of a movement of the position-movable shaft toward the position-fixed shaft.

Accordingly, it is possible to cause the slant posture of the supply plate to stably follow the contact point that is shifted in accordance with the abrasion of the first roll and/or the second roll thereby keeping enhanced efficiency of hulling operation, without providing a complicated structure such as a sensor for detecting the outer diameter(s) of the first roll and/or the second roll and a actuator for changing the slant posture of the supply plate based on a signal of the sensor.

In one embodiment, the link structure includes a fulcrum shaft that is disposed above and in parallel with the position-fixed shaft and the position-movable shaft, a link arm that is supported by the fulcrum shaft in a relatively non-rotatable manner with respect thereto in a state of having a lower end portion inserted between the position-fixed shaft and the position-movable shaft, a biasing member that operatively biases the link arm such that the lower end portion of the link arm is pressed to a portion of the position-movable shaft support member that faces the position-fixed shaft to cause the link arm to swing about the fulcrum shaft in cooperation with the movement of the position-movable shaft support member to be brought closer to and spaced apart form the position-fixed shaft, and a link mechanism that operatively connects the fulcrum shaft and the pivot shaft so that the pivot shaft is rotated about the axis line thereof in accordance with the rotation of the fulcrum shaft about the axis line thereof by the link arm, wherein a slant angle of the supply plate is changed by way of the link arm, the fulcrum shaft, the link mechanism and the pivot shaft in accordance with the movement of position-movable shaft support member to be brought closer to and spaced apart form the position-fixed shaft.

The configuration makes it possible to realize the above-mentioned effect while simplifying the link structure.

In a preferable embodiment, the position-movable shaft support member may have a proximal end portion supported in a rotatable manner about a rotational shaft that is disposed in parallel with the position-fixed shaft and the position-movable shaft, an arm portion extending radially outward from the proximal end portion with the axis line of the rotational shaft as a reference, a bearing portion provided at the arm portion so as to support the position-movable shaft in a rotatable manner about the axis line thereof, and a connecting portion to which the pressing mechanism is operatively connected.

In the configuration, the bearing portion has an outer peripheral surface in a substantially circular arc shape around the axis line of the position-movable shaft, and the lower end portion of the link arm is pressed by the biasing member to a portion of the outer peripheral surface of the bearing portion, the portion facing the position-fixed shaft.

The configuration makes it possible to smoothly and precisely transmit the movement of the position-movable shaft, which is rotated around the rotational shaft in accordance with abrasion of the first roll and/or the second roll, to the fulcrum shaft through the link arm, since the lower end portion of the link arm is engaged with the portion of the position-movable shaft support member that has the outer peripheral surface in a substantially circular arc shape. Accordingly, it is possible to cause the slant posture of the supply plate to precisely and stably follow the contact point that is shifted in accordance with the abrasion of the first roll and/or the second roll.

The link mechanism may include a first link supported by the fulcrum shaft in a relatively non-rotatable manner with respect thereto, a second link supported by the pivot shaft in a relatively non-rotatable manner with respect thereto, and an intermediate link having a first end portion that is connected to a free end portion of the first link in a relatively rotatable manner with respect thereto and a second end portion that is connected to a free end portion of the second link in a relatively rotatable manner with respect thereto.

The configuration makes it possible to enhance design freedom regarding arrangement of the fulcrum shaft and the pivot shaft. More specifically, the configuration makes it possible rotate the pivot shaft around the axis line thereof in conjunction with the rotation of the fulcrum shaft around the axis line thereof while arranging the fulcrum shaft at such a position as to allow the link arm to smoothly move in conjunction with the movement of the position-movable shaft support member and also arranging the pivot shaft at such a position as to allow the supply plate to receive material grain fallen from above and guide the same to the contact point, by suitably changing respective lengths of the first link, the second link and the intermediate link.

In a more preferable embodiment, the intermediate link is configured so as to have a longitudinal length capable of being changed.

The configuration makes it possible to change a slant angle of the supply plate with respect to a slant angle of the link arm by adjusting the longitudinal length of the intermediate link.

Accordingly, it is possible to accurately and easily adjust a relative posture of the link arm and the supply plate even after the link mechanism is assembled.

The grain huller may further include a material grain tank that is disposed above the first and second rolls, a supply shutter provided at a lower opening of the material grain tank, an upstream supply plate that receives material grain fallen from the lower opening and naturally flow the same downward to the supply plate, and a lead roller capable of adjusting amount of material grain to be supplied to the supply plate in cooperation with the upstream supply plate.

The upstream supply plate is supported by an upstream pivot shaft, which is disposed above and in parallel with the pivot shaft, in a relatively non-rotatable manner with respect thereto in a state where a slant direction of the upstream supply plate is opposite to that of the supply plate.

The grain huller may further include an electric motor having an output shaft that extends perpendicularly to the upstream pivot shaft and is driven to rotate about an axis line thereof and forms a screw thread at an outer peripheral surface, a driving member having a screw hole into which the screw thread is engaged and extending in parallel with the upstream pivot shaft, a driven member having a proximal end portion that is supported by the upstream pivot shaft in a relatively non-rotatable manner with respect thereto and a free end portion that is provided with an opening allowing the driving member to be engaged thereinto, a slant angle manipulating member capable of being manually operated, and a control unit controlling the electric motor based on an operation signal transmitted from the slant angle manipulating member.

The opening has such a shape as to prevent the driving member from being rotated about the axis line of the output shaft when the electric motor is in a driving state.

The control unit actuates the electric motor by an amount according to the operation signal transmitted from the slant angle manipulating member.

In the grain huller, when the electric motor is driven by the control unit so that the output shaft, which extends perpendicularly to the upstream pivot shaft, is rotated around the axis line thereof, the driving member, which extends in parallel with the upstream pivot shaft and is engaged with the output shaft through a threaded engagement, tries to rotate the axis line of the output shaft. However, since the driving member is engaged into an opening formed at the driven member that has a proximal end portion supported by the upstream pivot shaft in a relatively non-rotatable manner with respect thereto, the opening having such a shape as to prevent the driving member from being rotated about the axis line of the output shaft when the output shaft is rotated around the axis line thereof, the driving member moves in a reciprocating manner along the axis line of the output shaft without being rotated around the axis line of the output shaft, thereby rotating the upstream pivot shaft around the axis line thereof through the driven member so as to change the slant angle of the upstream supply plate.

As explained above, the grain huller makes it possible to precisely control the slant angle of the upstream supply plate by controlling actuation of the electric motor. More specifically, the grain huller makes it possible to accurately adjust the space between the upstream supply plate and the lead roller with use of the electric motor in accordance with amount of the material grain that is fed to the upstream supply plate from the material grain tank, thereby supplying the material grain in a layer state from the upstream supply plate to the supply plate.

In a more preferable embodiment, the control unit is configured so as to have a manual mode of controlling the electric motor based on the operation signal transmitted from the slant angle manipulating member and an automatic mode of automatically controlling the electric motor.

The control unit controls the electric motor to increase or decrease by a predetermined distance the space between the upstream supply plate and the lead roller based on signals transmitted from an upper limit sensor and a lower limit sensor of a tank of a sorter that is provided successively to the grain huller.

The configuration makes it possible to enhance the convenience of adjustment of the space between the upstream supply plate and the lead roller.

In particular, the automatic mode makes it possible to allow material grain to smoothly flow in an entire grain hulling system inclusive of the grain huller thereby improving the efficiency of the operation in the entire system, since feedback control is performed with using processing condition in a step subsequent to the grain huller.

In another embodiment, the link structure includes a restricting member that moves in accordance with the movement of the position-movable shaft support member to be brought closer to the position-fixed shaft, and a link rod having a distal end portion that is operatively connected to the restricting member and a proximal end portion that is supported by the pivot shaft in a relatively non-rotatable manner with respect thereto. The link structure is configured so as to rotate the pivot shaft in the axis line thereof through the restricting member and the link rod by use of the movement of the position-movable shaft support member.

The restricting member restricts the movement of the link rod so that a rotational direction of the pivot shaft around the axis line at the time when the link rod is moved in accordance with the movement of the position-movable shaft support member is set to such a direction as to cause the distal end portion of the supply plate to rotate around the pivot shaft in a direction toward the position-fixed shaft.

The configuration makes it also possible to cause the slant posture of the supply plate to stably follow the contact point that is shifted in accordance with the abrasion of the first roll and/or the second roll thereby keeping enhanced efficiency of hulling operation, without providing a complicated structure such as a sensor for detecting the outer diameter(s) of the first roll and/or the second roll and a actuator for changing the slant posture of the supply plate based on a signal of the sensor.

In a more preferable embodiment, the pivot shaft is arranged straight above the position-fixed shaft, and the link rod is bent in such a manner as that distal end portion is brought closer to the position-fixed shaft around the pivot shaft with respect to the proximal end portion.

The configuration makes it possible to cause the slant posture of the supply plate to more accurately follow the contact point that is shifted in accordance with the abrasion of the first roll and/or the second roll.

More specifically, in the configuration, the distal end portion of the link rod that is operatively connected to the restricting member crosses a trajectory of the movement of the position-movable shaft support shaft at a large angel (that is, an almost right angle). That is, the configuration can align as much as possible the direction of the movement of the restricting member that is in conjunction with the position-movable support member with the direction of the movement of the distal end portion of the link rod at the time when the link rod is rotated about the pivot shaft, thereby rotating the supply plate about the pivot shaft in a more corresponding manner with respect to the movement of the position-movable shaft. As a result, the slant posture of the supply plate can follow more accurately the displacement of the contact point between the both rolls.

The restricting member is preferably provided at the position-movable shaft support member.

The preferable configuration can cause the restricting member to move in conjunction with the position-movable shaft support member without providing a complicated structure.

In a preferable embodiment, the restricting member includes a lower surface forming therein an engagement opening in which the distal end portion of the link rod is engaged, and a pair of flat surfaces facing each other with the engagement opening being interposed therebetween, one of the pair of flat surfaces forming a side surface that restricts the movement of the link rod at an upper end portion.

The configuration makes it possible to effectively prevent the link rod from being detached from the restricting member (effectively prevent a disconnect between the link rod and the restricting member).

In the configuration, one portion of the restricting member connects the link rod thereto, and another portion of the restricting member restricts the movement of the link rod. Accordingly, both the connection and the restriction can be reliably and stably performed.

Furthermore, the present invention also provides a grain huller including a first roll supported by a position-fixed shaft in such a manner as to rotate along with the position-fixed shaft around an axis line thereof, a second roll supported by a position-movable shaft, which is disposed substantially parallel to the position-fixed shaft and can be brought closer to and spaced from the position-fixed shaft, in such a manner as to rotate along with the position-movable shaft around an axis line thereof, a pressing mechanism that presses the position-movable shaft in a direction toward the position-fixed shaft so that the second roll is pressed to the first roll, a supply plate having a proximal end portion supported by a pivot shaft in a relatively non-rotatable manner with respect to the pivot shaft that is disposed above and in parallel with the position-fixed shaft and the position-movable shaft, a link rod having a proximal end portion supported by the pivot shaft in a relatively non-rotatable manner with respect thereto, and a restricting member that restricts a movement of the link rod around the pivot shaft.

The supply plate and the link rod take such a posture as to apply biasing force by their own weights onto the pivot shaft to rotate the pivot shaft in one direction around the axis line.

The restricting member engages with the distal end portion of the link rod so as to keep against the biasing force a state in which the distal end portion of the supply plate is directed to a contact point between the first and second rolls.

The restricting member moves in accordance with the movement of the position-movable shaft caused by the abrasion of the first and second rolls so that an engagement position of the link rod around the pivot shaft is changed, whereby the distal end portion of the supply plate moves so as to follow the contact point that is shifted due to the abrasion of the first and second rolls.

The configuration makes it also possible to cause the slant posture of the supply plate to stably follow the contact point that is shifted in accordance with the abrasion of the first roll and/or the second roll thereby keeping enhanced efficiency of hulling operation, without providing a complicated structure such as a sensor for detecting the outer diameter(s) of the first roll and/or the second roll and a actuator for changing the slant posture of the supply plate based on a signal of the sensor.

DESCRIPTION OF THE REFERENCE NUMERALS

Figure 1:
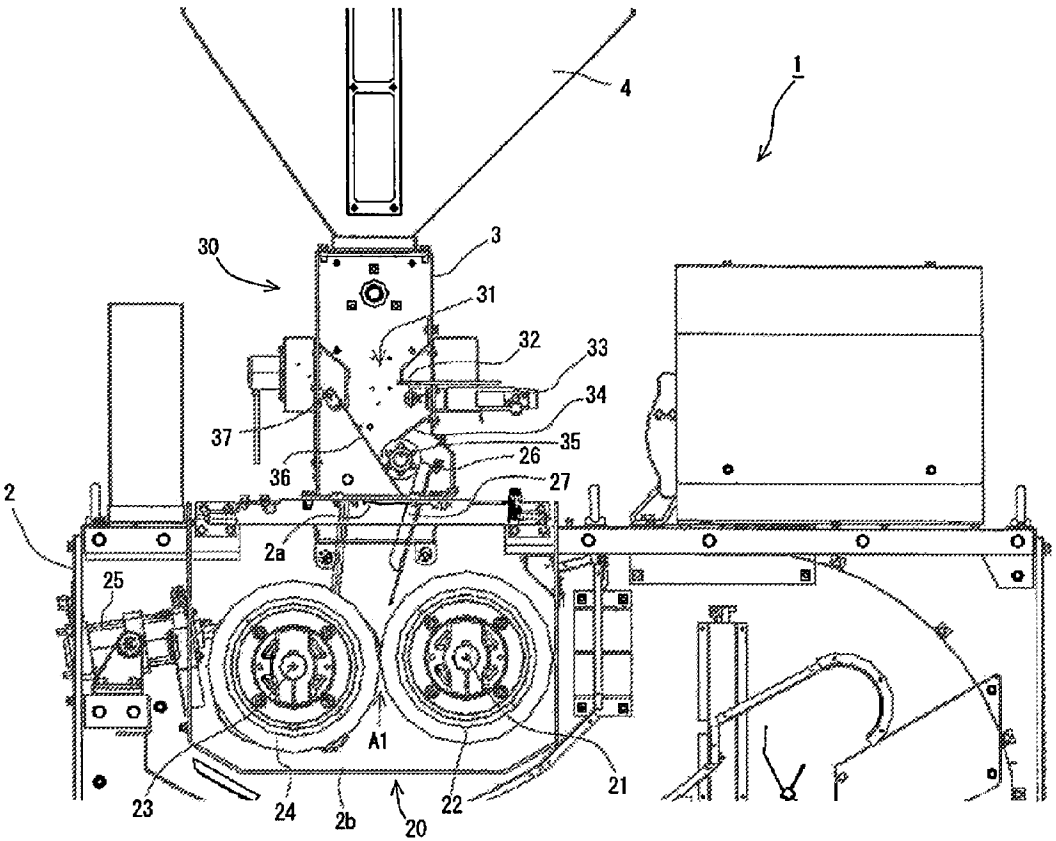
FIG. 1 is a front view of a grain huller according to a first embodiment of the present invention, and shows an initial state before a second roll of the grain huller is shifted.

1, 1' grain huller
4 material grain tank
6 electric motor (driving power source)
8 adjusting motor
10 sorter
11 upper limit sensor
12 lower limit sensor
21 position-fixed shaft
22 first roll
23 position-movable shaft
24 second roll
25 pressing mechanism
26 pivot shaft
27 supply plate
28 restricting member
29 link rod
32 supply shutter
35 lead roller
36 upstream supply plate
37 upstream pivot shaft
41 fulcrum shaft
42 link arm
43 biasing member
44 link mechanism
53 position-movable shaft support member

53*a* proximal end portion of position-movable shaft support member
53*b* arm portion of position-movable shaft support member
53*c* bearing portion of position-movable shaft support member
53*d* connecting portion of position-movable shaft support member
70 control unit
71 slant angle manipulating member
81 output shaft of adjusting motor
81*a* screw thread formed at output shaft of adjusting motor
82 driving member
82*a* screw hole formed at driving member
83 driven member
83*a* opening formed at driven member
281 engagement opening
282 lower surface
283 side surface
441 first link of link mechanism
442 second link of link mechanism
443 intermediate link of link mechanism
A1 contact point

BEST MODE FOR CARRYING OUT THE INVENTION

First Embodiment

Described below with reference to the accompanying drawings is a grain huller according to a preferred embodiment of the present invention.

Figure 2:
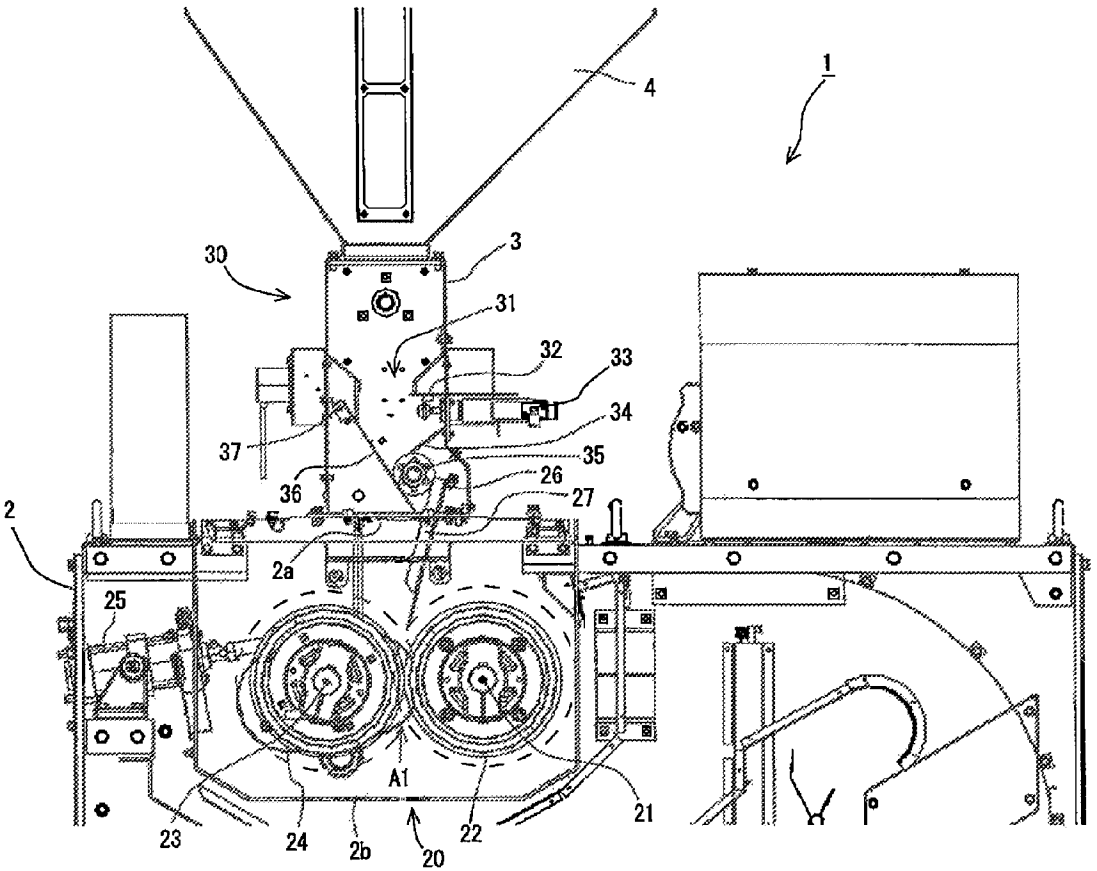
FIG. 2 is a front view of the grain huller in a state where the second roll has been shifted in accordance with abrasion of a first roll and the second roll of the grain huller.
Figure 3:
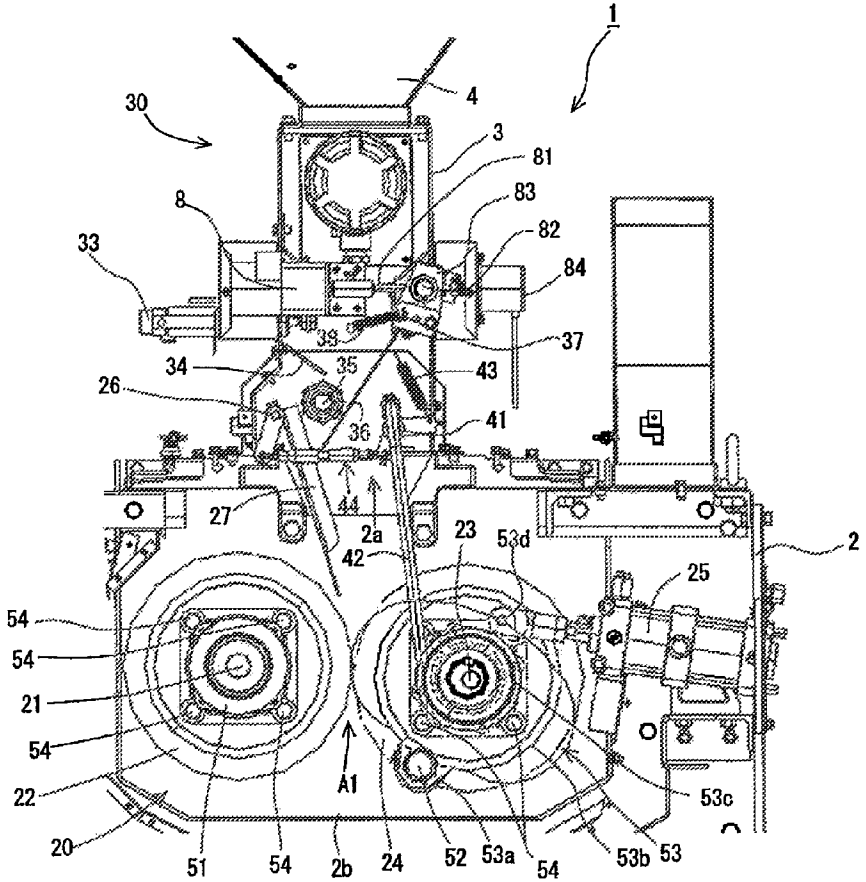
FIG. 3 is a rear view of the grain huller in the state shown in FIG. 1.
Figure 4:
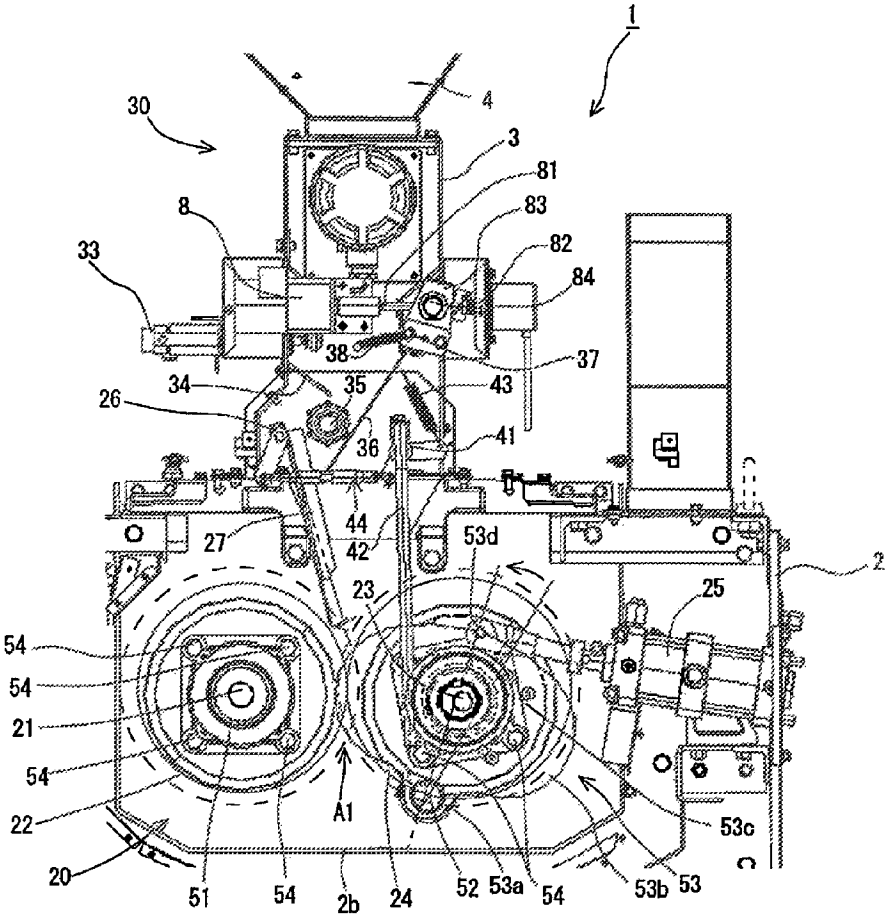
FIG. 4 is a rear view of the grain huller in the state shown in FIG. 2.
Figure 5:
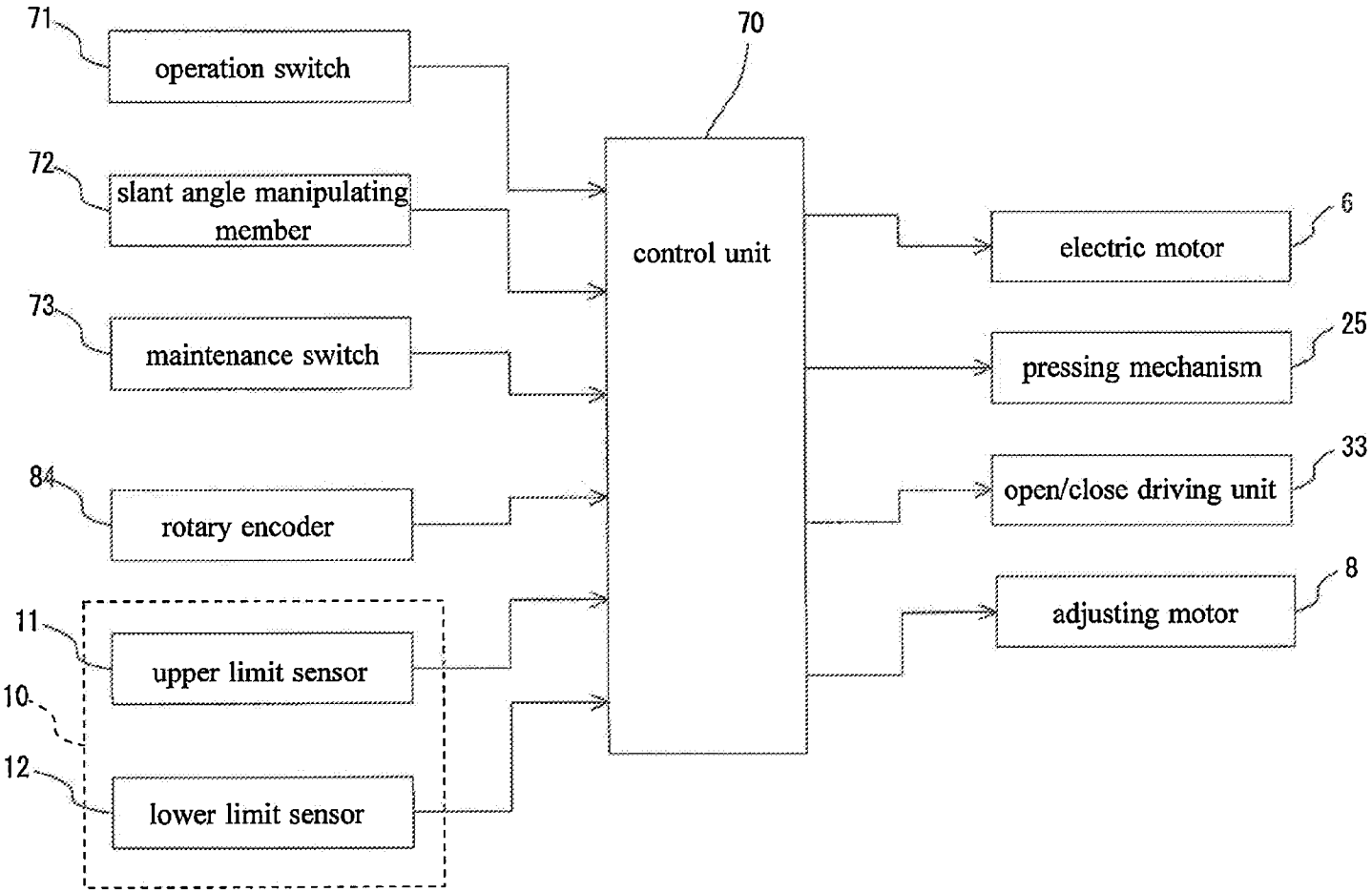
FIG. 5 is a block diagram of a control unit of the grain huller according to the first embodiment.
Figure 6:
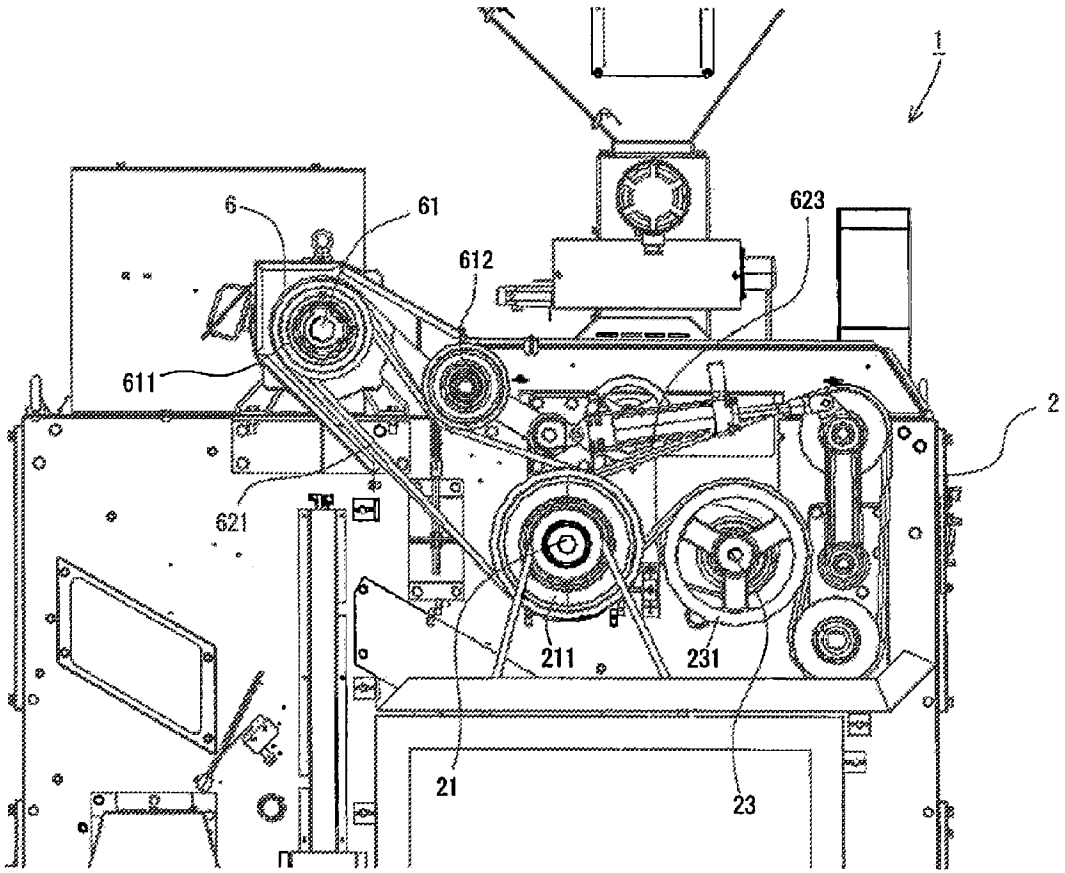
FIG. 6 is a view of a roll driving mechanism of the grain huller according to the first embodiment, the roll driving mechanism driving the first and second rolls.

FIGS. 1 and 2 are front views of a grain huller 1 according to a first embodiment of the present invention. FIGS. 3 and 4 are rear views of the grain huller 1 shown in FIGS. 1 and 2, respectively. FIGS. 1 and 3 show a state before a second roll 24, which will be described later, of the grain huller 1 is shifted (a state before rolls are abraded), while FIGS. 2 and 4 show a state after the second roll 24 is shifted (a state after the rolls are abraded). FIG. 5 is a block diagram showing a configuration of a control system of the grain huller 1 according to the present embodiment. FIG. 6 is a view showing a roll driving mechanism of the grain huller 1 according to the present embodiment.

As shown in FIGS. 1 to 4, the grain huller 1 according to the present embodiment includes a machine frame 2 that is provided with an upper opening 2*a* and a lower opening 2*b*, an upper frame 3 that is provided above the upper opening 2*a*, and a material grain tank 4 that is provided on top of the upper frame 3 and reserves material grain to be hulled.

The grain huller 1 further includes a huller unit 20 that removes chaff of the material grain, and a supply unit 30 that supplies to the huller unit 20 the material grain flowing downward from the material grain tank 4.

The upper frame 3 is provided with a supply port 31 that is located in the upper frame 3 and communicates between a lower opening of the material grain tank 4 and the huller unit 20 in the machine frame 2.

As shown in FIGS. 1 and 2, the supply unit 30 has a supply shutter 32, an open/close driving unit 33, a guide plate 34, a lead roller 35, and an upstream supply plate 36. The supply shutter 32 is provided at the supply port 31. The open/close driving unit 33 is provided outside the upper frame 3 and drives to open and close the supply shutter 32. The guide plate 34 is supported within the upper frame 3 and guides downward in a line grain supplied from the supply port 31. The lead roller 35 in a shape of an impeller is disposed inside the upper frame 3 so as to be located under the guide plate 34 and is supported so as to rotate along the slant direction of the guide plate 34 to cause grain to flow down to the huller unit 20 sequentially and quantitatively. The upstream supply plate 36 is disposed to face the guide plate 34 with the lead roller 35 being interposed therebetween so as to form a funnel shape in cooperation with the guide plate 34, and has an upper end portion that is supported in a rotatable manner about an upstream pivot shaft 37. The upstream supply plate 36 is rotated about the upstream pivot shaft 37 so as to adjust a space between the lead roller 35 and the upstream supply plate 36.

The lead roller 35 cooperates with the upstream supply plate 36 so as to adjust the quantity of the material grain to be fed from the upstream supply plate 36 to a supply plate 27, which is to be described later.

The present embodiment adopts an electric motor as the open/close driving unit 33. More specifically, the supply shutter 32 is connected to a shaft that is shifted in a reciprocating manner along its axis line by the electric motor, and controlling and driving the electric motor allow the supply shutter 32 to open and close the supply port 31.

As shown in FIGS. 1 to 5, the huller unit 20 has a position-fixed shaft 21, a position-movable shaft 23, a first roll 22, the second roll 24, and a pressing mechanism 25. The position-fixed shaft 21 is driven to rotate about an axis thereof at a first rotational speed by a rotational power from an electric motor 6 that functions as a driving power source. The position-movable shaft 23 is made movable so as to be brought closer to and spaced apart from the position-fixed shaft 21 while being substantially in parallel with the position-fixed shaft 21. The position-movable shaft 23 is driven to rotate about an axis thereof at a second rotational speed that is not equal to the first rotational speed by the rotational power from the electric motor 6. The first roll 22 is fixed to the position-fixed shaft 21 in a relatively non-rotatable with respect thereto by attachment screws 54 that are screwed along the axis line of the position-fixed shaft 21. The second roll 24 is fixed to the position-movable shaft 23 in a relatively non-rotatable manner with respect thereto by attachment screws 54 that are screwed along the axis line of the position-movable shaft 23. The pressing mechanism 25 directly or indirectly presses the position-movable shaft 23 so that the second roll 24 is pressed toward the first roll 22 at a predetermined pressure.

The grain huller 1 further includes a pivot shaft 26 and the supply plate 27. The pivot shaft 26 is disposed above and in parallel with the position-fixed shaft 21 and the position-movable shaft 23. The supply plate 27 is supported by the pivot shaft 26 in a relatively non-rotatable manner with respect thereto, and causes the material grain, which has been fed from above, to naturally flow downward toward a contact point A1 between the first roll 22 and the second roll 24.

The supply plate 27 is supported by the pivot shaft 26 in a relatively non-rotatable manner with respect thereto, and is slanted in a direction that is opposite to a slant direction of the upstream supply plate 36 with the vertical direction as a reference.

As shown in FIG. 5, the grain huller 1 also includes an operation switch 71 and a control unit 70. The operation switch 71 turns ON/OFF state of hulling operation with use of the first roll 22 and the second roll 24. The control unit 70 controls the electric motor 6 and the pressing mechanism 25 based on an operation signal transmitted from the operation switch 71.

The control unit 70 has an operating unit and a memory unit (none of which being shown) and controls the grain huller 1 based on a program stored in the memory unit. For example, the control unit 70 is embodied as a microcomputer that is mounted to an electrical circuit in the grain huller 1, or as an external computer that is electrically connected to the grain huller 1.

As shown in FIG. 6, the first roll 22 and the second roll 24 are driven to rotate in opposite directions to each other with having rotational speeds unequal to each other by a driving power that is transmitted by way of a pulley/belt transmission mechanism from the electric motor 6 provided outside the machine frame 2.

More specifically, the pulley/belt transmission mechanism includes pulleys 611, 211, and 231, as well as driving belts 621 and 623. The pulley 611 is supported by an output shaft 61 of the electric motor 6 in a relatively non-rotatable manner with respect thereto. The pulley 211 is supported by the position-fixed shaft 21 in a relatively non-rotatable manner with respect thereto. The pulley 231 is supported by the position-movable shaft 23 in a relatively non-rotatable manner with respect thereto. The driving belt 621 is provided to surround the pulley 611 and the pulley 211. The driving belt 623 is provided to surround the pulley 211 and the pulley 231.

In the present embodiment, the pulley 211 includes a first pulley and a second pulley. The first pulley is surrounded by the driving belt 621. The second pulley is surrounded by the driving belt 623 and has a diameter unequal to that of the first pulley. This configuration differentiates the rotational speed of the position-fixed shaft 21 from that of the position-movable shaft 23.

The driving belt 623 also surrounds a direction-changing pulley such that the position-movable shaft 23 is rotated in a direction different from the rotational direction of the position-fixed shaft 21.

The lead roller 35 is also rotated in a direction to supply the material grain into the huller unit 20 by the driving power that is transmitted from the electric motor 6 by way of a driving belt.

The grain huller 1 according to the present embodiment includes a tension roller 612 that applies and releases tension to the driving belt 621. The control unit 70 controls the position of the tension roller 612 such that the tension roller 612 applies or releases tension to of from the driving belt 621 in accordance with operation to the operation switch 71. In this configuration, the driving power of the electric motor 6 is selectively transmitted or blocked to the first roll 22 and the second roll 24.

As shown in FIG. 3, the grain huller 1 according to the present embodiment includes a position-fixed shaft support member 51 that supports the position-fixed shaft 21 via a bearing in a rotatable manner about the axis line thereof. The position-fixed shaft support member 51 is fixed to the machine frame 2.

Figure 7:
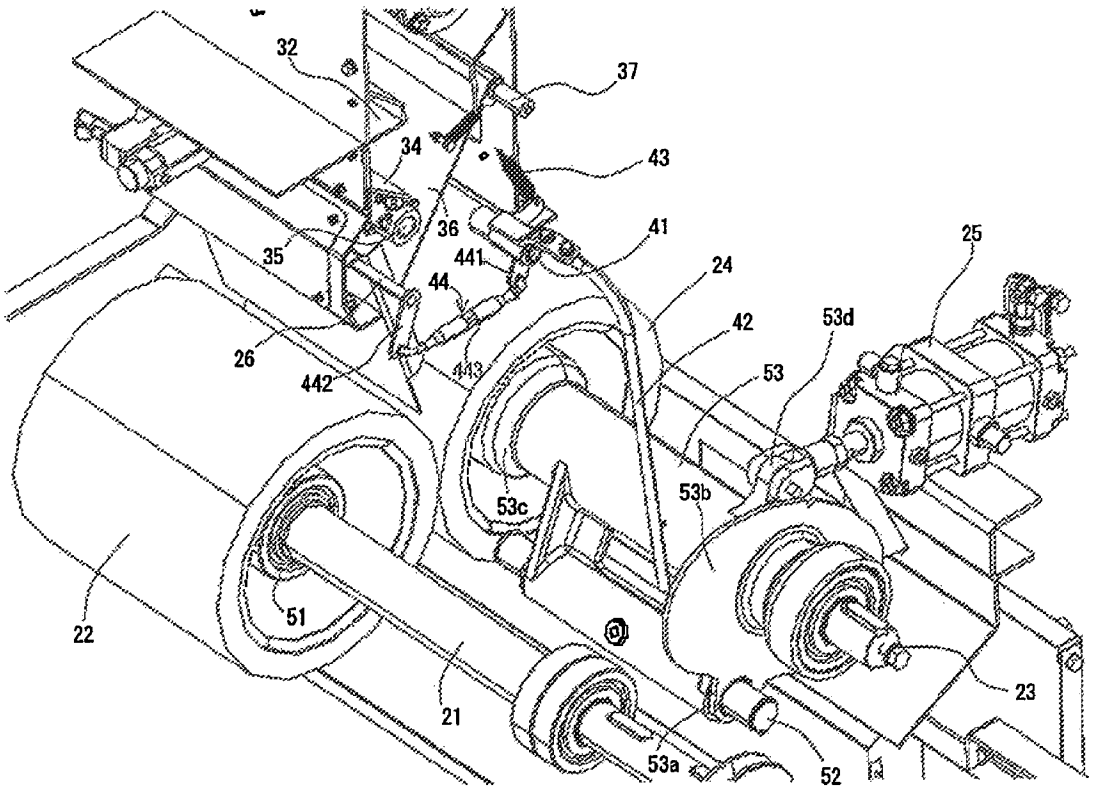
FIG. 7 is a perspective view of the vicinity of the first and second rolls of the grain huller according to the first embodiment.

FIG. 7 is a perspective view showing the vicinity of the rolls of the grain huller 1 according to the present embodiment.

As shown in FIGS. 3 and 7, the grain huller 1 includes a position-movable shaft support member 53 that supports the position-movable shaft 23 via a bearing in a rotatable manner about the axis line thereof.

The position-movable shaft support member 53 has a proximal end portion 53*a*, an arm portion 53*b*, a bearing portion 53*c*, and a connecting portion 53*d*. The proximal end portion 53*a* is supported in a rotatable manner about a rotational shaft 52 that is disposed in parallel with the position-movable shaft 23. The arm portion 53*b* extends radially outward from the proximal end portion 53*a* with the axis line of the rotational shaft 52 as a reference. The bearing portion 53*c* is provided at the arm portion 53*b* so as to support the position-movable shaft 23 in a rotatable manner about the axis line thereof. The connecting portion 53*d* is operatively connected to the pressing mechanism 25.

In this configuration, the second roll 24 is rotated about the rotational shaft 52 as the bearing portion 53*c* is rotated about the rotational shaft 52.

In the present embodiment, the pressing mechanism 25 has a first end portion connected to the machine frame 2 and a second end portion connected to the connecting portion 53*d*. The pressing mechanism 25 presses the position-movable shaft support member 53 about the rotational shaft so as to bring the second roll 24 closer to the first roll 22, with a result that the first roll 22 and the second roll 24 are made in pressure contact with each other. In the present embodiment, the first end portion of the pressing mechanism 25 is fixed to a side surface of the machine frame 2 that is close to the second roll 24.

The present embodiment adopts an air cylinder as the pressing mechanism 25. However, the present invention is not limited to such a configuration, but may adopt an electric motor as the pressing mechanism 25, for example.

The proximal end portion 53*a* and the connecting portion 53*d* are disposed radially opposite to each other with the position-movable shaft 23 as a reference. In this configuration, the position-movable shaft support member 53 is supported at the both sides of the position-movable shaft 23, so that the second roll 24 can be securely supported.

The supply plate 27 has a proximal end portion that is supported by the pivot shaft 26 in a relatively non-rotatable manner with respect thereto, and a distal end portion that extends from the proximal end portion toward the contact point A1 between the pair of first and second rolls 22 and 24.

The pivot shaft 26 is disposed above the first roll 22 and the second roll 24, more precisely, at a position closer to the position-fixed shaft 21 relative to the contact point A1 between the first and second rolls, such that the axis thereof is substantially in parallel with the position-fixed shaft 21 and the position-movable shaft 23.

The proximal end portion of the supply plate 27 is supported by the pivot shaft 26 in a relatively non-rotatable manner with respect thereto, and the distal end portion thereof extends from the proximal end portion toward the contact point A1 between the pair of first and second rolls 22 and 24, so that the material grain slides down on the surface of the supply plate 27 that faces the second roll 24.

In the present embodiment, the grain huller 1 includes a link structure for operatively connecting the position-movable shaft support member 53 and the pivot shaft 26 such that the slant angle of the supply plate 27 is changed in accordance with the motions of the position-movable shaft support member 53 to be brought closer to and spaced apart from the position-fixed shaft 21.

More specifically, the link structure includes a fulcrum shaft 41, a link arm 42, a biasing member 43, and a link mechanism 44. The fulcrum shaft 41 is disposed above and in parallel with the position-fixed shaft 21 and the position-movable shaft 23. The link arm 42 is supported by the fulcrum shaft 41 in a relatively non-rotatable manner with respect thereto in a state of having a lower end portion inserted between the position-fixed shaft 21 and the position-movable shaft 23. The biasing member 43 operatively biases the link arm 42 such that the lower end portion of the link arm 42 is pressed to a portion of the position-movable shaft support member 53 that faces the position-fixed shaft 21 to cause the link arm 42 to swing about the fulcrum shaft 41 in cooperation with the motions of the position-movable shaft support member 53 to be brought closer to and spaced apart form the position-fixed shaft 21. The link mechanism 44 operatively connects the fulcrum shaft 41 and the pivot shaft 26 so that the pivot shaft 26 is rotated about the axis line thereof in accordance with the rotation of the fulcrum shaft 41 about the axis line thereof by the link arm 42.

The thus configured link structure changes the slant angle of the supply plate 27 by way of the link arm 42, the fulcrum shaft 41, the link mechanism 44, and the pivot shaft 26 in accordance with the motions of the position-movable shaft support member 53 to be brought closer to and spaced apart from the position-fixed shaft 21.

In the present embodiment, the link mechanism 44 includes a first link 441, a second link 442, and an intermediate link 443. The first link 441 is supported by the fulcrum shaft 41 in a relatively non-rotatable manner with respect thereto. The second link 442 is supported by the pivot shaft 26 in a relatively non-rotatable manner with respect thereto. The intermediate link 443 has a first end portion connected to a free end portion of the first link 441 in a relatively rotatable manner with respect thereto, and a second end portion connected to a free end portion of the second link 442 in a relatively rotatable manner with respect thereto.

The bearing portion 53*c* has an outer peripheral surface in a substantially circular arc shape around the axis line of the position-movable shaft 23. The lower end portion of the link arm 42 is pressed by the biasing member 43 to a portion of the outer peripheral surface of the bearing portion 53*c*, the portion facing the position-fixed shaft 21.

Described below is the flow of hulling operation of the grain huller 1.

The operation switch 71 is firstly turned from the OFF state to the ON state, and the control unit 70 then actuates the electric motor 6 to rotate the first roll 22, the second roll 24, and the lead roller 35, as well as drives the open/close driving unit 33 to open the supply shutter 32. Accordingly, the material grain reserved in the material grain tank 4 flows downward into the supply unit 30. The material grain thus flowed downward slides down along a flow path that is formed by the guide plate 34 and the upstream supply plate 36 that are disposed below the supply unit 30, and is supplied to the lead roller 35.

By the rotation of the lead roller 35, the material grain supplied to the lead roller 35 is sequentially and quantitatively fed to the huller unit 20 inside the machine frame 2 in a state of forming a uniform layer in accordance with the size of the space between the lead roller 35 and the upstream supply plate 36.

When the operation switch 71 is turned to the ON state, the control unit 70 further actuates the pressing mechanism 25, so that the second roll 24 is rotated about the rotational shaft 52 to be shifted toward the first roll 22.

In the present embodiment, the pressing mechanism 25 operatively connected to the connecting portion 53*d* rotates the position-movable shaft support member 53 about the rotational shaft 52. Accordingly, the position-movable shaft 23, which is supported by the bearing portion 53*c* in a rotatable manner about the axis line thereof, is also rotated about the rotational shaft 52 so as to move toward the position-fixed shaft 21.

As a result, there is provided the contact point A1 between the first roll 22 and the second roll 24, where the first roll 22 and the second roll 24 are pressed to each other at a predetermined pressure.

The material grain supplied from the supply unit 30 slides downward along the surface (facing the second roll 24) of the supply plate 27 so as to be fed to the contact point A1 between the first roll 22 and the second roll 24, to which the distal end portion of the supply plate 27 is directed. The first roll 22 and the second roll 24 are rotated at speeds unequal to each other by the rotational power transmitted from the electric motor 6, with the second roll 24 being pressed toward the first roll 22 at a predetermined pressure by the pressing mechanism 25 by way of the position-movable shaft support member 53. The material grain supplied by the supply plate 27 to the contact point A1 is thus hulled with use of the first and second rolls 22 and 24, and is discharged from the lower opening 2*b*. The material grain discharged from the lower opening 2*b* is sorted into hulled grain particles and chaff by a sorter mechanism such as a blowing sorter (not shown).

Assume that the first roll 22 and/or the second roll 24 is abraded due to repeated use from the state shown in FIGS. 1 and 3 and the outer diameter(s) of the roll(s) is decreased as shown in FIGS. 2 and 4 (in which broken lines indicate the outer shapes of the first roll 22 and the second roll 24 before being abraded as in FIGS. 1 and 3). In this case, a pressing force of the pressing mechanism 25 rotates the second roll 24 about the rotational shaft 52 so as to be shifted toward the first roll 22 (FIGS. 2 and 4), so that the first roll 22 and the second roll 24 are kept in pressure contact with each other while the contact point A1 between the rolls 22 and 24 having been displaced.

As describe above, the supply plate 27 is operatively connected by way of the pivot shaft 26 and the link mechanism 44 to the fulcrum shaft 41 that is positioned above the position-fixed shaft 21 and the position-movable shaft 23 and in parallel with the both shafts. The fulcrum shaft 41 also supports a proximal end portion of the link arm 42 in a relatively non-rotatable manner with respect thereto. More specifically, the link arm 42 has a lower end side inserted between the position-fixed shaft 21 and the position-movable shaft 23 and biased by a biasing force of the biasing member 43 toward a side of the position-movable shaft support member 53 that faces the position-fixed shaft 21, and an upper end side supported by the fulcrum shaft in a relatively non-rotatable manner with respect thereto. That is, the lower end side of the link arm 42 is constantly come in contact with the side of the position-movable shaft support member 53 that faces the position-fixed shaft 21 by the biasing force of the biasing member 43.

Therefore, when the position-movable shaft support member 53 and the position-movable shaft 23 are rotated by the pressing mechanism 25 about the rotational shaft 52 so as to be brought closer to the position-fixed shaft 21 in accordance with degrees of abrasion of the first roll 22 and the second roll 24, the link arm 42 swings about the fulcrum shaft 41 against the biasing force of the biasing member 43 so that the fulcrum shaft 41 is rotated about the axis line thereof. The rotation of the fulcrum shaft 41 about the axis line thereof causes the rotation of the pivot shaft 26 about the axis line thereof via the link mechanism 44, so that the slant angle of the supply plate 27 is changed.

More specifically, when the link arm 42 swings about the fulcrum shaft 41 and the fulcrum shaft 41 is rotated about the axis line thereof, also rotated about the fulcrum shaft 41 is the first link 441 of the link mechanism 44, which is supported by the fulcrum shaft 41 in a relatively non-rotatable manner with respect thereto. When the first link 441 is rotated about the fulcrum shaft 41, the second link 442, which is supported by the pivot shaft 26 in a relatively non-rotatable manner with respect thereto, is rotated about the pivot shaft 26 via the intermediate link 443, and the pivot shaft 26 is rotated about the axis line thereof. When the pivot shaft 26 is rotated about the axis line thereof, the supply plate 27, the upper end portion of which is supported by the pivot shaft 26 in a relatively non-rotatable manner with respect thereto, is swung about the pivot shaft 26, so that the slant angle of the supply plate 27 is changed.

As described above, in the grain huller 1 according to the present embodiment, in a case where the second roll 24 is pressed by the pressing mechanism 25 due to the abrasion of the first roll 22 and/or the second roll 24, the supply plate 27 is rotated about the pivot shaft 26 via the link arm 42, the fulcrum shaft 41, the link mechanism 44, and the pivot shaft 26. Accordingly, the slant posture of the supply plate 27 is automatically changed such that the distal end portion of the supply plate 27 follows the contact point A1 that has been displaced in accordance with the shift of the second roll 24.

In other words, in the grain huller 1 according to the present embodiment, the slant posture of the supply plate 27 is automatically adjusted such that the distal end portion of the supply plate 27 follows the contact point A1 between the first roll 22 and the second roll 24, which is displaced in accordance with degrees of abrasion of the first roll 22 and/or the second roll 24, without additionally providing a sensor for detecting the outer diameter(s) of the first roll 22 and/or the second roll 24 or a controller for changing the slant posture of the supply plate 27 based on the result of detection. Therefore, the supply plate 27 is allowed to easily and stably follow the position of contact between the pair of first and second rolls 22 and 24, which is displaced in accordance with degrees of abrasion of the first roll 22 and/or the second roll 24. As a result, excellently kept is the efficiency of hulling operation with use of the first roll 22 and the second roll 24.

In the present embodiment, the bearing portion 53*c* of the position-movable shaft support member 53 has the outer peripheral surface in the substantially circular arc shape around the axis line of the position-movable shaft 23. Accordingly, the link arm 42, which is biased by the biasing force of the biasing member 43 toward the portion of the bearing portion 53*c* that faces the position-fixed shaft 21, is in point contact with the outer peripheral surface of the bearing portion 53*c* that has the substantially circular arc shape.

In this configuration, it is possible to smoothly and precisely transmit to the fulcrum shaft 41 by way of the link arm 42 the motions of the position-movable shaft support member 53 that is rotated about the rotational shaft 52 in accordance with degrees of abrasion of the first roll 22 and/or the second roll 24. Therefore, the position of the supply plate 27 is allowed to stably follow the displacement of the contact point A1 between the rolls 22 and 24 due to the abrasion of the first roll 22 and/or the second roll 24.

Moreover, in the present embodiment, the first link 441 and the second link 442 are connected together via the intermediate link 443. This configuration allows the fulcrum shaft 41 and the pivot shaft 26 to be freely disposed, resulting in enhancement of the flexibility in designing the link arm 42 and the supply plate 27. Therefore, the supply plate 27 can be shifted more smoothly in accordance with the movement of the position-movable shaft 23.

Furthermore, in the present embodiment, the intermediate link 443 has a longitudinal length that is made adjustable.

For example, the intermediate link 443 may have a first member that configures a first side, a second member that configures a second side, and an adjusting member that connects the first and second sides. The adjusting member may have screwed portions at the two ends that are respectively screwed into the first and second members in the longitudinal direction thereof.

In such a case where the longitudinal length of the intermediate link 443 is made adjustable, the swing angle of the supply plate 27 can be easily adjusted with respect to the swing angle of the link arm 42.

Therefore, it is possible to adjust the slant posture of the supply plate 27 more accurately and easily by slightly adjusting the longitudinal length of the intermediate link 443 even after the link mechanism 44 is assembled.

The grain huller 1 according to the present embodiment is configured so that the space between the upstream supply plate 36 and the lead roller 35 is elastically adjusted.

Figure 8:
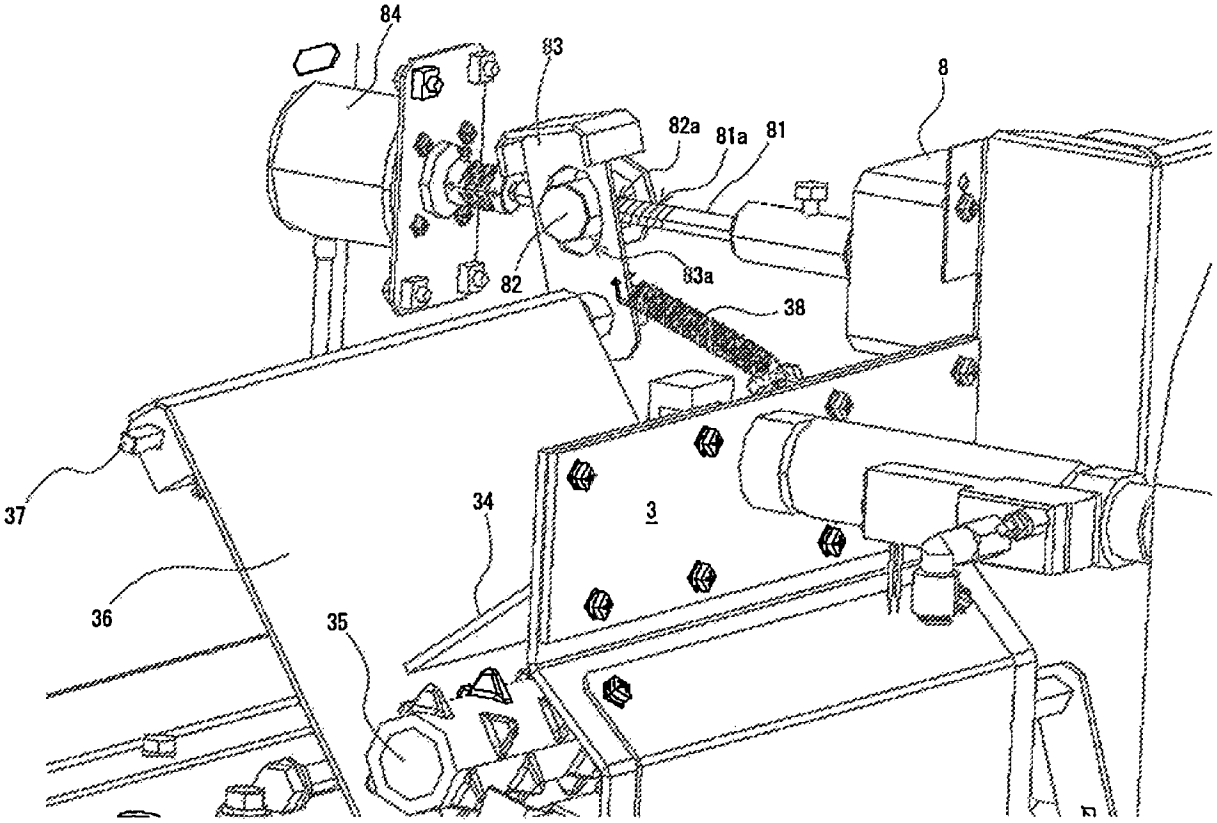
FIG. 8 is a perspective view of the vicinity of a mechanism of the grain huller according to the first embodiment, the mechanism adjusting a slant angle of upstream supply plate 36.

FIG. 8 is a perspective view of the upstream supply plate 36 and the vicinity thereof in the grain huller 1 according to the present embodiment.

As shown in FIGS. 5 and 8, the grain huller 1 includes an electric motor (adjusting motor 8), a driving member 82, a driven member 83, and a slant angle manipulating member 72. The electric motor (adjusting motor 8) has an output shaft 81 that extend perpendicularly to the upstream pivot shaft 37 and is driven to rotate about an axis line thereof. The driving member 82 has a screw hole 82*a* that allows a screw thread 81*a* provided at the outer peripheral surface of the output shaft 81 to be screwed thereinto, and extends in parallel with the upstream pivot shaft 37. The driven member 83 has a proximal end portion that is supported by the upstream pivot shaft 37 in a relatively non-rotatable manner with respect thereto and a free end portion that is provided with an opening 83*a* allowing the driving member 82 to be engaged thereinto. The slant angle manipulating member 72 can be manually operated. The control unit 70 controls to drive the adjusting motor 8 so that the adjusting motor 8 is actuated by an amount according to an operation signal transmitted from the slant angle manipulating member 72.

More specifically, the opening 83*a* provided at the driven member 83 is shaped so as to prevent the driving member 82 from being rotated about the axis line of the output shaft 81 upon driving the adjusting motor 8, so that the driving member 82 is shifted along the axis line of the output shaft 81 and the driven member 83 is thereby rotated about the upstream pivot shaft 37. More specifically, the opening 83*a* has a slotted shape whose longitudinal direction is along a virtual line that passes the rotational axis line of the upstream pivot shaft 37 and the axis line of the driving member 82.

The upstream supply plate 36 is biased toward the lead roller 35 by a biasing member 38 that is attached to the driven member 83.

In the grain huller 1 thus configured, the space between the upstream supply plate 36 and the lead roller 35 are adjusted as follows.

In response to manual operation of the slant angle manipulating member 72, the control unit 70 actuates the adjusting motor 8 by an amount according to an operation signal transmitted from the slant angle manipulating member 72. The adjusting motor 8 thus actuated rotates the output shaft 81 about the axis line thereof, which extends perpendicularly to the upstream pivot shaft 37. As the screw thread 81*a* provided at the outer peripheral surface of the output shaft 81 is screwed into the screw hole 82*a* in the driving member 82 that extends in parallel with the upstream pivot shaft 37, the driving member 82 is likely to rotate about the axis line of the output shaft 81 in response to the rotation of the output shaft 81 about the axis line thereof.

However, the driving member 82 is engaged into the opening 83*a* of the driven member 83 that has the proximal end portion supported by the upstream pivot shaft 37 in a relatively non-rotatable manner with respect thereto. The opening 83*a* has the slotted shape that prevents the driving member 82 from rotating about the axis line of the output shaft 81. Therefore, in a case where the output shaft 81 of the adjusting motor 8 is rotated about the axis line thereof, the driving member 82 is shifted forward and backward along the axis line of the output shaft 81.

When the driving member 82 is shifted forward and backward along the axis line of the output shaft 81, the driven member 83, which is engaged with the driving member 82 via the opening 83*a*, is swung about the upstream pivot shaft 37 against the biasing force of the biasing member 38.

As described above, when the driving member 82 is shifted forward and backward along the axis line of the output shaft 81 in accordance with driving of the adjusting motor 8, the driven member 83 rotates the upstream pivot shaft 37 about the axis line thereof, resulting in change of the slant angle of the upstream supply plate 36.

This configuration achieves precise control of the slant angle of the upstream supply plate 36 by controlling to actuate the adjusting motor 8. In other words, it is possible to precisely adjust the space between the upstream supply plate 36 and the lead roller 35 in accordance with the quantity of the material grain fed from the material grain tank 4 to the upstream supply plate 36. Therefore, the material grain can be supplied from the upstream supply plate 36 to the supply plate 27 in a shape of a uniform layer.

The grain huller 1 according to the present embodiment further includes a rotary encoder 84 that detects a rotational angle of the output shaft 81. The control unit 70 controls to actuate the adjusting motor 8 based on an amount detected by the rotary encoder 84. Alternatively, in place of the rotary encoder 84, the control unit 70 may in advance store data regarding the rotational speeds (the relation between the periods of actuation and the rotational angles) of the adjusting motor 8, and drive to rotate the adjusting motor 8 for a predetermined period of time that is defined based on the data in order to actuate the adjusting motor 8 by an amount according to the operation signal transmitted from the slant angle manipulating member 72.

Figure 9:
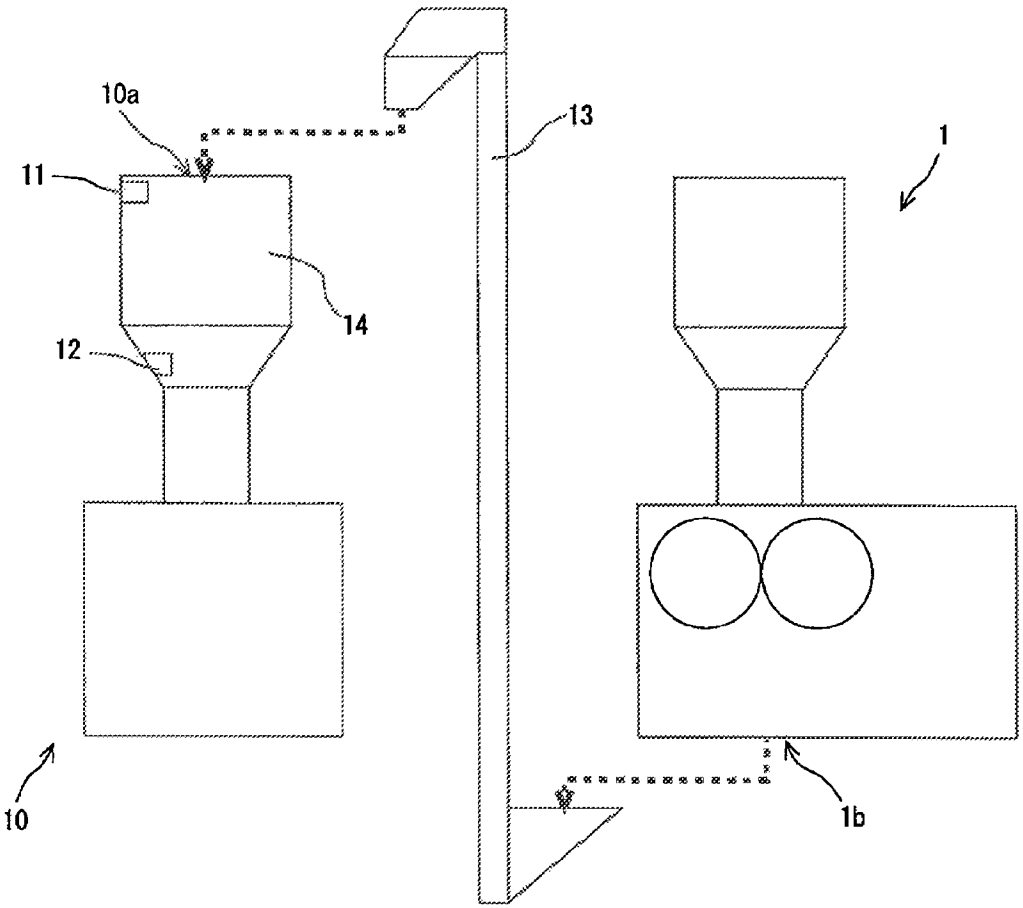
FIG. 9 is a schematic view of one example of a grain hulling system to which the grain huller according to the first embodiment is applied.

FIG. 9 is a schematic diagram exemplifying a configuration of a grain hulling system, to which the grain huller according to the present embodiment is applied.

In the example shown in FIG. 9, the grain huller 1 form the grain hulling system in cooperation with a sorter (swinging sorter) 10 that is provided successively to the grain huller 1. More specifically, in the grain hulling system, the grain huller 1 performs hulling operation and blowing sort operation to obtain resultant grain, to which the sorter 10 successively performs sorting operation. In this configuration, inserted between a lower opening 1*b* of the grain huller 1 and an upper opening 10*a* of a tank of the sorter 10 is a sorter pour lift 13 for conveying the resultant grain.

The grain huller 1 according to the present embodiment may be configured so that the control unit 70 has a manual mode and an automatic mode. In the manual mode, the control unit 70 controls the adjusting motor 8 based on an operation signal transmitted from the slant angle manipulating member 72. In the automatic mode, the adjusting motor 8 is automatically controlled.

For example, the control unit 70 may initiate the manual mode in response to a manual operation of the slant angle manipulating member 72.

In the manual mode, the control unit 70 controls the adjusting motor 8 based on an operation signal transmitted from the slant angle manipulating member 72.

On the other hand, in the automatic mode, the control unit 70 may control the adjusting motor 8 based on the speed of hulling operation by the grain huller 1 and the speed of sorting operation by the sorter 10.

In the grain hulling system shown in FIG. 9, during the automatic mode, the control unit 70 may control the adjusting motor 8 in accordance with the quantity of grain reserved in the tank 14 of the sorter 10 that is provided successively to the grain huller 1.

For example, the tank 14 may be provided with an upper limit sensor 11 and a lower limit sensor 12, and the control unit 70 may control the adjusting motor 8 to increase or decrease by a predetermined distance the space between the upstream supply plate 36 and the lead roller 35 based on signals transmitted from the upper limit sensor 11 and the lower limit sensor 12.

Furthermore, in the case where the tank 14 of the sorter 10 is provided with the upper limit sensor 11 and the lower limit sensor 12, the control unit 70 may initiate the automatic mode based on detection signals transmitted from the upper limit sensor 11 and the lower limit sensor 12.

More specifically, in a case where only the lower limit sensor 12 detects a stack of grain, the control unit 70 will determine that the condition is normal and will not output a control signal to the adjusting motor 8 (in which case, the space between the upstream supply plate 36 and the lead roller 35 is kept unchanged).

In a case where the stack of grain is detected by both of the upper limit sensor 11 and the lower limit sensor 12, the control unit 70 will determine that the speed of hulling operation by the grain huller 1 is too fast in cooperation with the speed of sorting operation by the sorter 10, and will control to decrease the speed of hulling operation by the grain huller 1 in comparison to the normal condition. More specifically, the control unit 70 controls the adjusting motor 8 so that the space between the upstream supply plate 36 and the lead roller 35 is narrowed by a predetermined distance with reference to the normal condition.

To the contrary, in a case where the stack of grain is detected by none of the upper limit sensor 11 and the lower limit sensor 12, the control unit 70 will determine that the speed of hulling operation by the grain huller 1 is too slow in cooperation with the speed of sorting operation by the sorter 10, and will control to increase the speed of hulling operation by the grain huller 1 in comparison to the normal condition. More specifically, the control unit 70 controls the adjusting motor 8 so that the space between the upstream supply plate 36 and the lead roller 35 is widened by a predetermined distance with reference to the normal condition.

The configuration where the adjusting motor 8 is feedback controlled in accordance with the condition of reserved grain in the step subsequent to the grain huller 1 as described above makes it possible to improve the efficiency of the operation in the entire grain hulling system inclusive of the grain huller 1.

The control unit 70 may preferably have a maintenance mode that is initiated in accordance with external operation.

More specifically, in the maintenance mode, the control unit 70 actuates the pressing mechanism 25 so that the second roll 24 is pressed toward the first roll 22 with the electric motor 6 not being driven.

As shown in FIG. 5, the grain huller 1 according to the present embodiment includes a maintenance switch 73 to be operated for initiating the maintenance mode. The maintenance switch 73 is provided outside the machine frame 2, for example.

Figure 10:
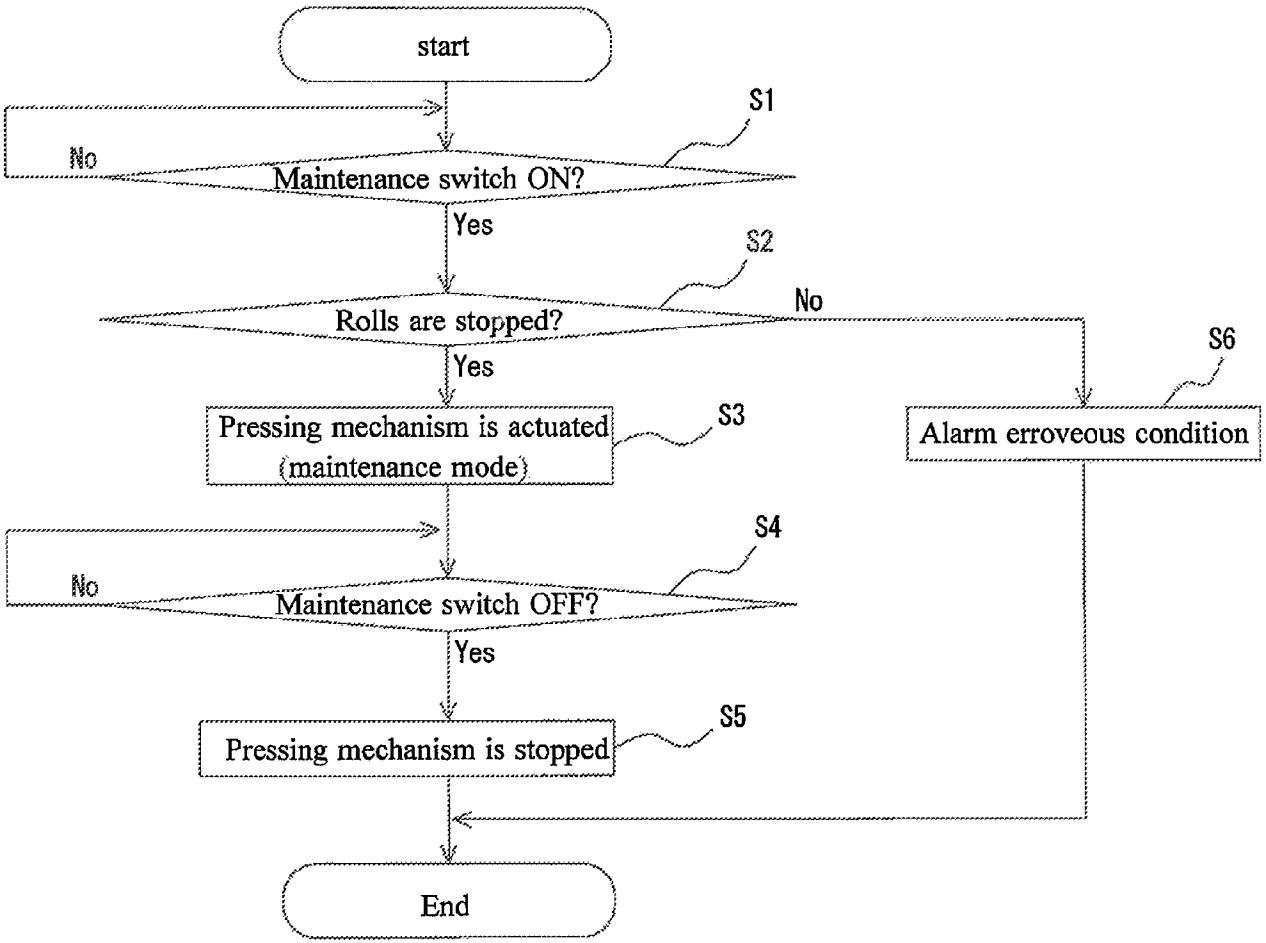
FIG. 10 is a control flowchart of a maintenance mode of the grain huller according to the first embodiment.

FIG. 10 is a flowchart showing the control operation in the maintenance mode.

As described earlier, in the grain huller 1 according to the present embodiment, the first roll 22 is fixed to the position-fixed shaft 21 by the attachment screws 54 that are screwed along the axis line of the position-fixed shaft 21, while the second roll 24 is fixed to the position-movable shaft 23 by the attachment screws 54 that are screwed along the axis line of the position-movable shaft 23.

When the operation switch 71 is turned to the ON state from the OFF state, the control unit 70 initiates the hulling operation mode of actuating the electric motor 6 so as to drive to rotate the position-fixed shaft 21 and the position-movable shaft 23, as well as controlling to actuate the pressing mechanism 25 so that the pressure applied between the first roll 22 and the second roll 24 has a predetermined strength.

Accordingly, the first roll 22 and the second roll 24 are rotated at speeds unequal to each other by the rotational power of the electric motor 6, with the second roll 24 being pressed at a predetermined pressure toward the first roll 22 by the pressing mechanism 25.

On the other hand, in the maintenance mode, the control unit 70 performs the following control operation.

As shown in FIG. 10, only in a case where the maintenance switch 73 is operated (Yes in step S1) and the first roll 22 and the second roll 24 are not driven to rotate (Yes in step S2), the control unit 70 initiates the maintenance mode (step S3). In the maintenance mode, the control unit 70 actuates the pressing mechanism 25 to press the second roll 24 toward the first roll 22 in a state where none of the first roll 22 and the second roll 24 is driven to be rotated by the electric motor 6. Upon detecting that the maintenance switch 73 is operated again (Yes in step S4), the control unit 70 releases the second roll 24 from pressing the first roll 22 by the pressing mechanism 25 (step S5).

As explained above, in the maintenance mode, the first roll 22 and the second roll 24 are made in pressure contact with each other while none of the first roll 22 and the second roll 24 being rotated.

In this state, it is possible to extremely easily tighten and loosen the attachment screws 54 upon exchanging the first roll 22 and/or the second roll 24.

More specifically, upon exchanging the first roll 22 and/or the second roll 24, it is necessary to loosen and tighten the attachment screws 54 that are screwed along the axis line of the position-fixed shaft 21 and/or the axis line of the position-movable shaft 23.

The position-fixed shaft 21 and the position-movable shaft 23 are supported respectively by the position-fixed shaft support member 51 and the position-movable shaft support member 53 in a rotatable manner about the respective axis lines thereof. Accordingly, loosening and/or tightening the attachment screws 54 causes the position-fixed shaft 21 and/or the position-movable shaft 23 to be rotated about the respective axis lines thereof, which deteriorates the efficiency of loosening and/or tightening the attachment screws 54.

However, in the maintenance mode, as described above, the first roll 22 and the second roll 24 are made in pressure contact with each other while none of the first roll 22 and the second roll 24 being rotated.

In this maintenance mode, when the attachment screws 54 are loosened to detach the corresponding roll from either one of the position-fixed shaft 21 and the position-movable shaft 23, the remaining roll supported by the other one of the position-fixed shaft 21 and the position-movable shaft 23 prevents the rotation of the former roll. Therefore, it is possible to prevent the position-fixed shaft 21 and the position-movable shaft 23 from cooperatively rotating when loosening and/or tightening the attachment screws 54. As a result, it is possible to improve the efficiency of detaching and attaching the first roll 22 and/or the second roll 24 with no additional provision of any special tool or any special structure.

The pressing mechanism 25 is preferably actuated in the maintenance mode so that the second roll 24 is pressed toward the first roll 22 at a pressure equal to the predetermined pressure during hulling operation.

In other words, the pressing operation by the pressing mechanism 25 in the maintenance mode can be made identical with the pressing operation by the pressing mechanism 25 during hulling operation.

The above configuration is particularly effective in the case where the air cylinder is adopted as the pressing mechanism 25 as in the grain huller 1 according to the present embodiment.

More specifically, if the pressing operation by the pressing mechanism 25 in the maintenance mode is made different from the pressing operation by the pressing mechanism 25 during hulling operation in the case where the air cylinder is adopted as the pressing mechanism 25, the control unit 70 needs to have an additional control flow for controlling the actuation of the pressing mechanism 25 or there is required an additional configuration for restricting or enhancing the pressing operation by the pressing mechanism 25.

The pressing force applied between the first and second rolls 22 and 24 by the pressing mechanism 25 during hulling operation is sufficiently large enough to prevent the cooperative rotations of the position-fixed shaft 21 and the position-movable shaft 23 during loosening and tightening the attachment screws 54.

Therefore, if the pressing operation by the pressing mechanism 25 in the maintenance mode can be made identical with the pressing operation by the pressing mechanism 25 during hulling operation, it is possible to facilitate detaching and attaching the first and second rolls 22 and 24 substantially with no need for any additional member.

In a configuration in which an electric motor is adopted as the pressing mechanism 25, the pressure applied between the first roll 22 and the second roll 24 is controlled by the control of the value of an electric current flowing in the electric motor. In this configuration, for example, the electric current value that causes the distance between the first roll 22 and the second roll 24 to be equal to zero may be set as the electric current value in the maintenance mode.

As described earlier, the control unit 70 is configured not to transit to the maintenance mode in a case where the first roll 22 and the second roll 24 are being driven to rotate. Therefore, even if the maintenance switch 73 is operated during hulling operation, the control unit 70 does not initiate the maintenance mode.

The above configuration does not stop the first roll 22 and the second roll 24 that are being driven to rotate even in a case where the maintenance switch 73 is erroneously operated during hulling operation. Therefore, it is possible to prevent defective hulling operation caused by erroneous operation.

Alternatively, the maintenance switch 73 may be made inoperable during hulling operation by providing a restricting member or the like.

In a further alternative configuration, if the maintenance switch 73 is operated when the first roll 22 and the second roll 24 are being driven to rotate (No in step S2), it is possible to alarm the erroneous condition (step S6) with use of sound or light.

In addition to the control modes described above, it is preferable not to transit to the hulling operation mode during the maintenance mode. In this case, the control unit 70 is configured not to initiate the hulling operation mode during the maintenance mode even in a case where the operation switch 71 is turned to the ON state.

In the present embodiment, the slant angle of the upstream supply plate 36 is electrically adjusted with use of the adjusting motor 8. However, the present invention is not limited to such a configuration. Alternatively, the slant angle of the upstream supply plate 36 can be manually adjusted.

For example, there may be provided an adjusting screw that can be manually operated and has a distal end in contact with the rear surface of the upstream supply plate 36 and a proximal end extending outward from the upper frame 3. In this case, the slant angle of the upstream supply plate 36 can be adjusted with use of this adjusting screw.

Second Embodiment

Next, another embodiment of the grain huller according to the present invention will be explained with reference to the accompanying drawings.

Figure 11:
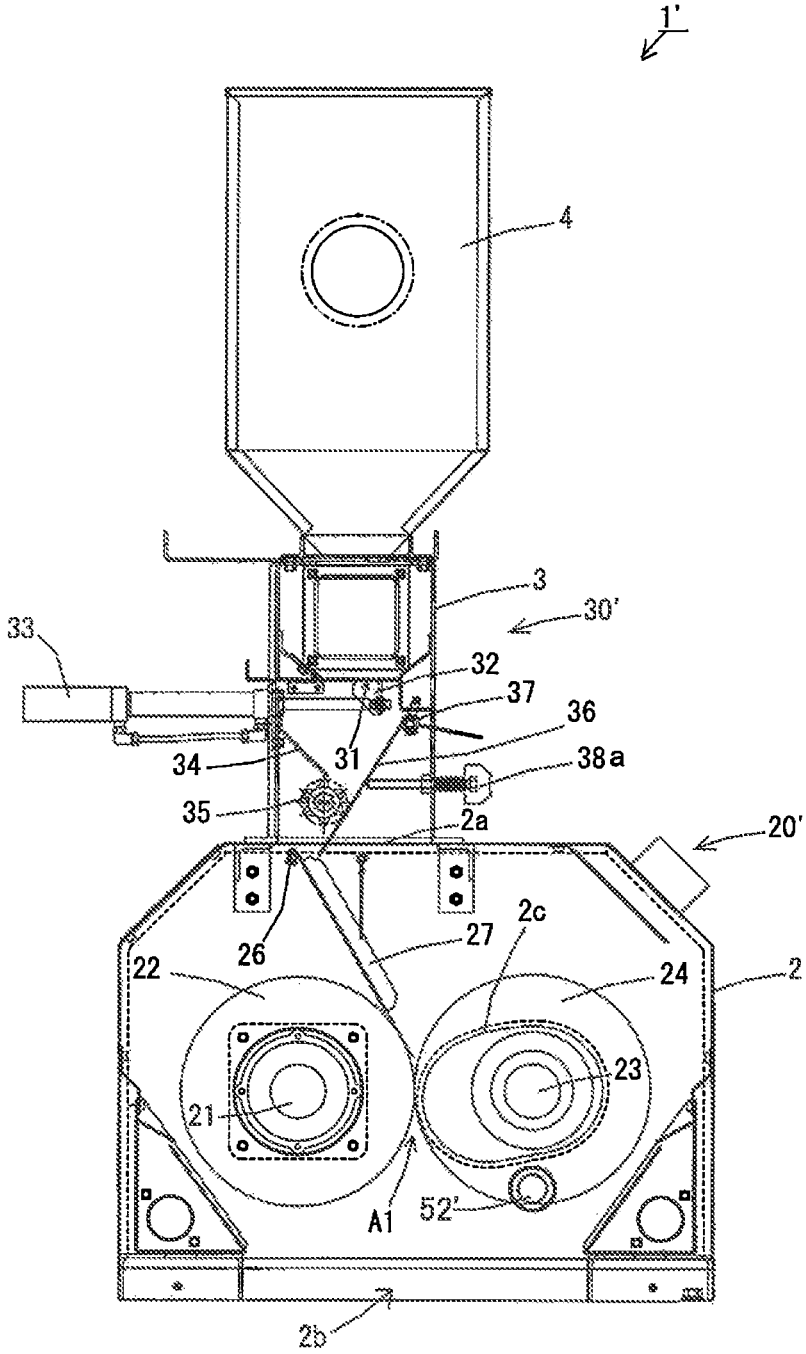
FIG. 11 is a front view of a grain huller according to a second embodiment of the present invention, and shows an initial state before a second roll of the grain huller is shifted.
Figure 12:
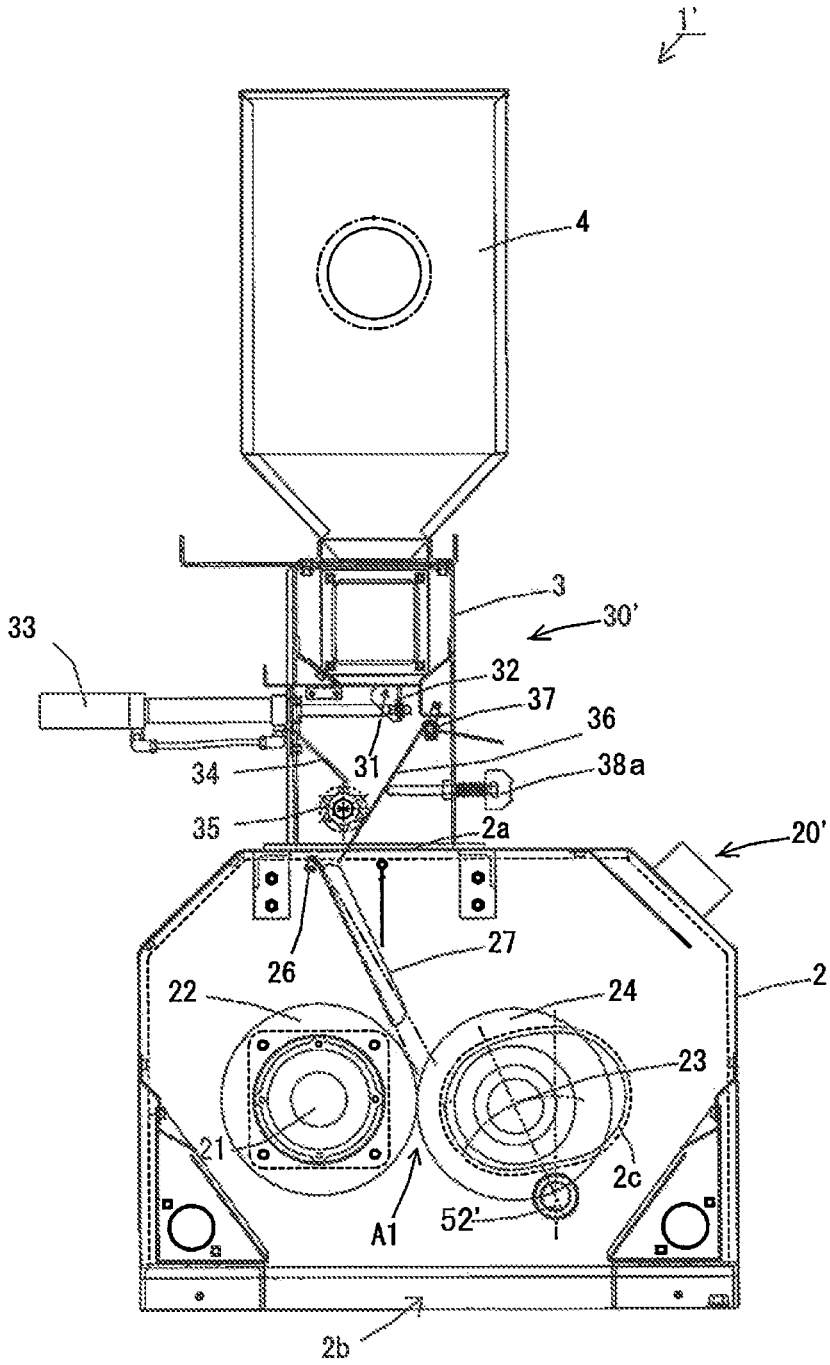
FIG. 12 is front view of the grain huller according to the second embodiment of the present invention in a state after the second roll has been shifted.
Figure 13:
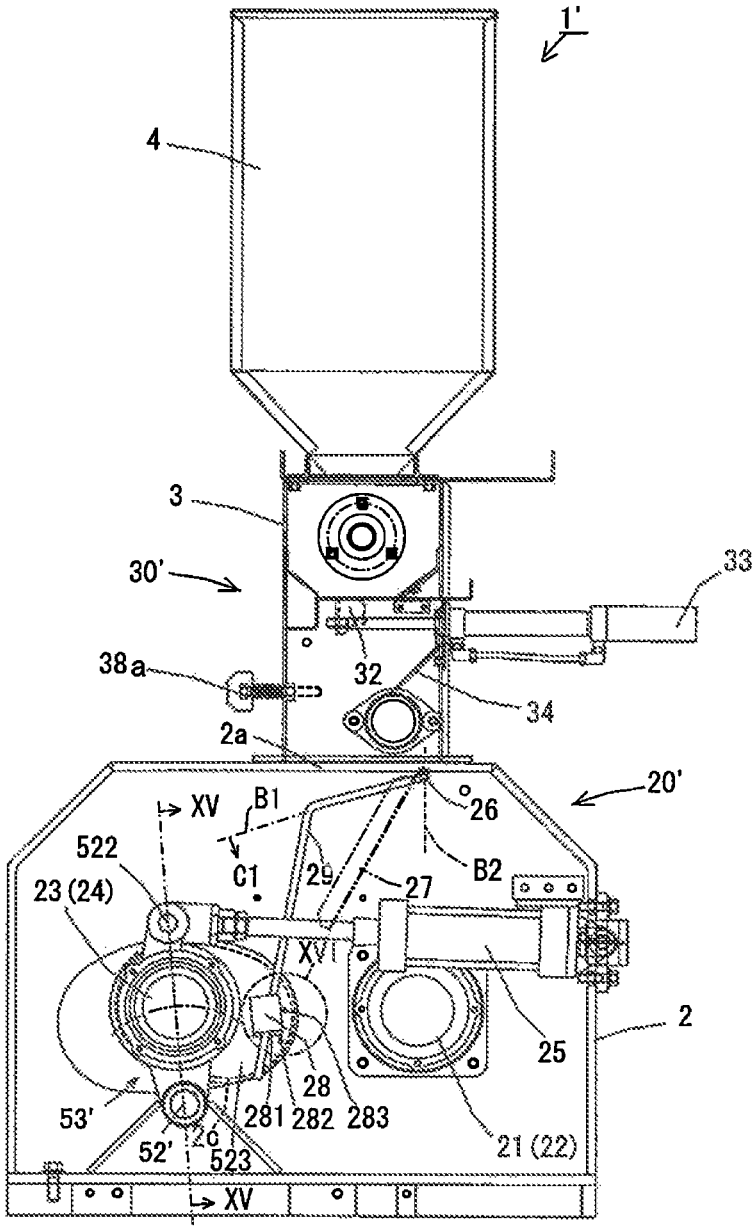
FIG. 13 is a rear view of the grain huller in the state shown in FIG. 11.
Figure 14:
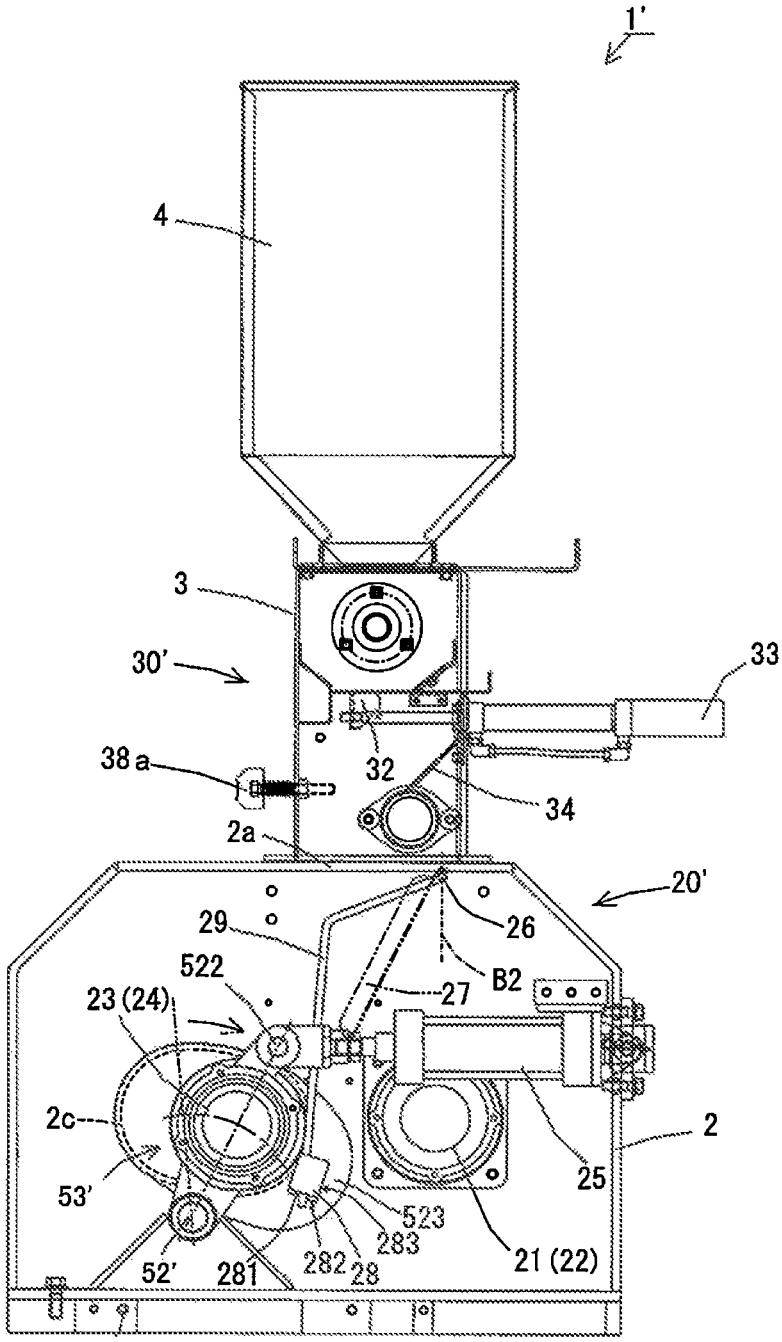
FIG. 14 is a rear view of the grain huller in the state shown in FIG. 12.
Figure 15:
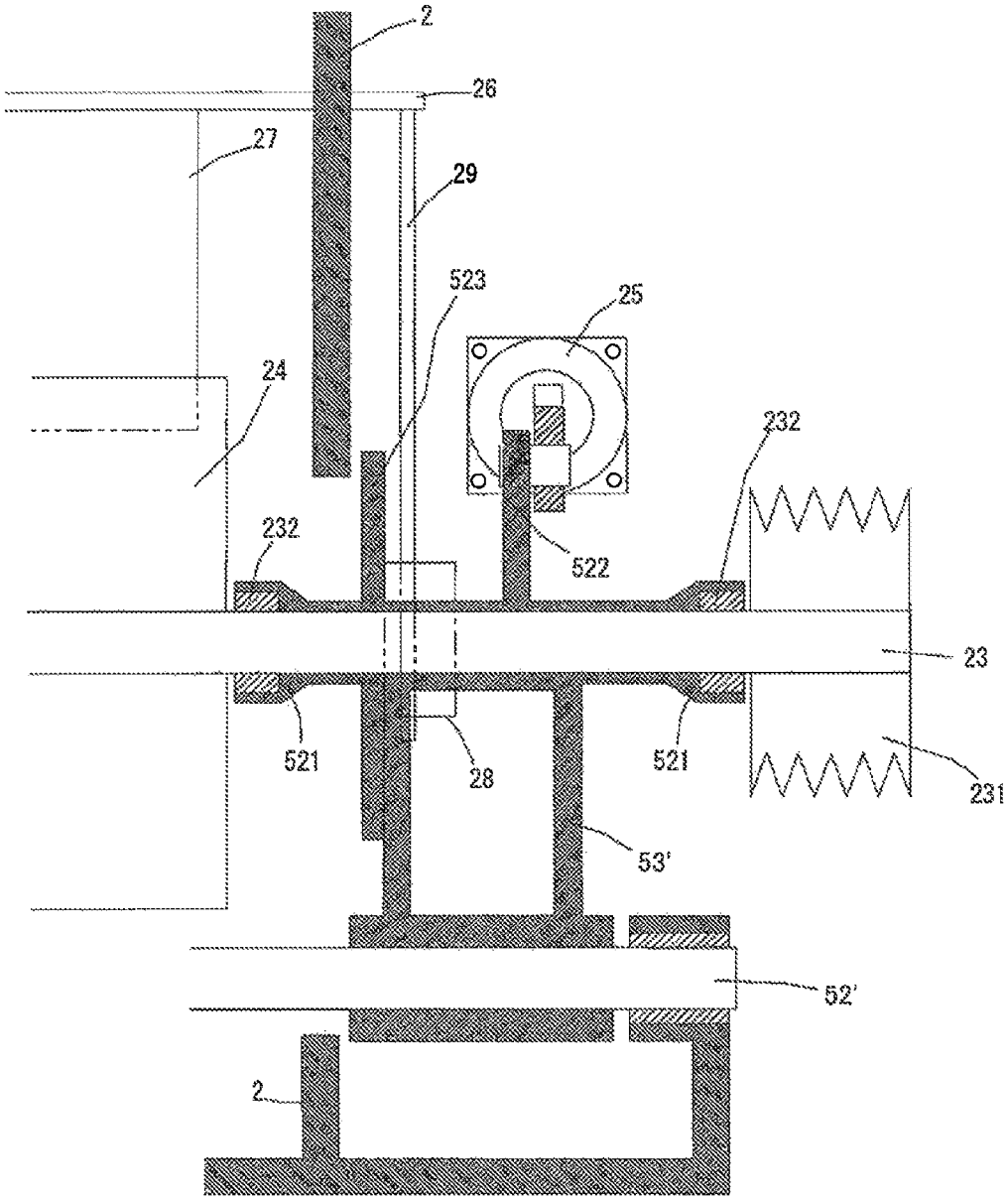
FIG. 15 is a cross sectional view taken along line XV-XV in FIG. 13.

FIGS. 11 and 12 are front views of a grain huller 1' according to the second embodiment of the present invention, and FIGS. 13 and 14 are rear views of the grain huller 1' shown in FIGS. 11 and 12, respectively. FIGS. 11 and 13 show a state before the second roll 24 of the grain huller 1' is shifted (a state before rolls are abraded), while FIGS. 12 and 14 show a state after the second roll 24 is shifted (a state after the rolls are abraded). FIG. 15 is a cross sectional view of the grain huller 1' taken along line XV-XV in FIG. 13.

In the drawings, the members same as those in the first embodiment are denoted by the same reference numerals to omit detailed description thereof.

Just like the grain huller 1 according to the first embodiment, the grain huller 1' also includes the machine frame 2, the upper frame 3 and the material grain tank 4.

The grain huller 1' further includes a huller unit 20' that removes chaff of the material grain, and a supply unit 30' that supplies to the huller unit 20' the material grain flowing downward from the material grain tank 4.

As shown in FIGS. 11 and 12, the supply unit 30' has the supply shutter 32 provided at the supply port 31 of the upper frame 3, the open/close driving unit 33, the guide plate 34, the lead roller 35, and the upstream supply plate 36.

In the present embodiment, the upstream supply plate 36 is configured so that its slant posture is manually changed.

More specifically, the supply unit 30' further includes an adjusting screw 38. The adjusting screw 38 has a distal end portion that comes in contact with the rear surface of the upstream supply plate 36 and a proximal end portion that functions as a gripped portion and extends outward from the upper frame 3. The rotational angle (slant posture) of the upstream supply plate 36 is changed by changing an amount of insertion of the adjusting screw 38 into the upper frame 3 with using the gripped portion.

The present embodiment also adopts the electric motor as the open/close driving unit 33.

In the same manner as the huller unit 20 in the first embodiment, the huller unit 20' includes the position-fixed shaft 21, the first roll 22 supported by the position-fixed shaft 21, the position-movable shaft 23, the second roll 24 supported by the position-movable shaft 23, the pressing mechanism 25, the pivot shaft 26, and the supply plate 27, as shown in FIGS. 11-14.

The huller unit 20' further includes a link structure for operatively connecting the position-movable shaft 23 and the pivot shaft 26 such that the slant angle of the supply plate 27 is changed in accordance with the motions of the position-movable shaft 23 to be brought closer to and spaced apart from the position-fixed shaft 21.

In the present embodiment, the link structure includes a restricting member 28 (see FIGS. 13 and 14) that moves in accordance with the movement of the second roll 24, and a link rod 29 (see FIGS. 13 and 14) having a distal end portion that is operatively connected to the restricting member 28 and a proximal end portion that is supported by the pivot shaft 26 in a relatively non-rotatable manner with respect thereto.

The restricting member 28 controls a movement of the link rod 29 in such a manner as that the distal end portion of the supply plate 27 is directed toward the contact point A1 between the first roll 22 and the second roll 24 in accordance with the movement of the second roll 24.

The first roll 22 and the second roll 24 are operatively connected by way of the driving belt (not shown) to the driving power source (not shown) provided outside the machine frame 2 so as to rotate in opposite directions to each other with having rotational speeds unequal to each other.

The rolls 22 and 24 are driven to rotate with use of the driving belts surrounding the pulley 231 (see FIG. 15) that is supported by the position-movable shaft 23 in a relatively non-rotatable manner with respect thereto, the pulley (not shown) that is supported by the position-fixed shaft 21 in a relatively non-rotatable manner with respect thereto, and the pulley (not shown) that is supported by the output shaft of the driving power source in a relatively non-rotatable manner with respect thereto.

For example, by making the diameter of the pulley 231 fixed to the position-movable shaft 23 different from the diameter of the pulley fixed to the position-fixed shaft 21, it is possible to make the rotational speeds of the first roll 22 and the second roll 24 unequal to each other while using a common power source.

The lead roller 35 is also rotated by the driving power from the same driving power source by way of the driving belt so as to supply material grain to the huller unit 20'.

The grain huller 1' according to the present embodiment further includes a boss member (position-movable shaft support member) 53' that supports the position-movable shaft 23 in a rotatable manner around the axis line thereof and rotates along with the position-movable shaft 23 about a rotational shaft 52' in substantially parallel with the position-movable shaft 23, as shown in FIG. 15.

More specifically, the boss member 53' includes a bearing holding portion 521 that supports the position-movable shaft 23 in a rotatable manner around the axis line thereof via a bearing 232.

When the boss member 53' rotates about the rotational shaft 52', the position-movable shaft 23 and the second roll 24 supported by the position-movable shaft 23 also rotate about the rotational shaft 52'.

In the present embodiment, as shown in FIGS. 11-14, the machine frame 2 is provided at front and rear surfaces with permission openings that allow the boss member 52 to rotate about the rotational shaft 51.

The pressing mechanism 25 has the first end portion connected to the machine frame 2 and the second end portion connected to the boss member 53'. The pressing mechanism 25 presses the boss member 53' around the rotational shaft 52' in such a direction as that the second roll is brought closer to the first roll 22, with a result that the first roll 22 and the second roll 24 are made in pressure contact with each other. In the present embodiment, the first end portion of the pressing mechanism 25 is fixed to the side surface of the machine frame 2 that is close to the first roll 22.

The present embodiment also adopts the air cylinder as the pressing mechanism 25. However, the present invention is not limited to such a configuration, but may adopt an electric motor as the pressing mechanism 25, for example.

The boss member 53' includes a connected portion 522 that is opposite to the rotational shaft 52' with the position-movable shaft 23 as a reference, and the second end portion of the pressing mechanism 25 is connected to the connected portion 522. The configuration realizes that the boss member 53' is supported at both sides between which the position-movable shaft 23 is sandwiched, so that the second roll 24 can be securely supported.

The supply plate 27 has the proximal end portion supported by the pivot shaft 26, which is positioned above the first roll 22 and the second roll 24, in a relatively non-rotatable manner with respect thereto, and the distal end portion extending from the proximal end portion toward the contact point A1 between the pair of first and second rolls 22 and 24, so that the material grain slides down on the surface of the supply plate 27 that faces the second roll 24.

The pivot shaft 26 is disposed substantially parallel to the position-movable shaft 23, at a position that is substantially straight above the position-fixed shaft 21 and is around an edge of the upper opening 2*a* that is close to the position-fixed shaft 21.

The link rod 29 has the proximal end portion supported by the pivot shaft 26 in a relatively non-rotatable manner with respect thereto.

Therefore, the supply plate 27 rotates around the pivot shaft 26 as the link rod 29 rotates around the pivot shaft 26. In the present embodiment, the pivot shaft 26 has a first end that is extended outward from the machine frame 2, as shown in FIG. 15, and the proximal end portion of the link rod 29 is supported by a portion of the pivot shaft 26 that is outside the machine frame 2 in a relatively non-rotatable manner with respect thereto.

The restricting member 28 is rotated along with the second roll 24 around the rotational shaft 52' by the pressing mechanism 25.

The link rod 29 has a distal end portion engaged with the restricting member 28 that moves in accordance with the movement of the second roll 24.

More specifically, when the second roll 24 is rotated about the rotational shaft 52' by the pressing mechanism 25, the restricting member 28 is also rotated about the rotational shaft 52', with a result that the slant posture of the link rod 29 is changed.

More specifically, as shown in FIG. 13, the link rod 29 has a distal end portion locked to the restricting member 28 in a state where the supply plate 27 and the link rod 29 are located on a side close to the contact point A1 with a virtual vertical plane B2, which passes the axis line of the pivot shaft 26, as a reference and take such a slant posture as to swing about the pivot shaft 26 toward the virtual vertical plane B2 due to their own weights.

More specifically, the restricting member 28 is engaged with the link rod 29 to restrict the supply plate 27 and the link rod 29, which are supported by the pivot shaft 26 in a relatively non-rotatable manner with respect thereto, from swinging due to their own weights about the pivot shaft 26 in a direction toward the virtual vertical plane B2 (one of the directions around the axis line of the pivot shaft 26, which is hereinafter referred to as an own-weighted swinging direction C1 (FIG. 13)).

This configuration makes it possible to automatically direct the distal end portion of the supply plate 27 toward the contact point A1 in accordance with the displacement of the second roll 24.

More specifically, the pressing mechanism 25 rotates the boss member 53' about the rotational shaft 52', which causes the second roll 24 to be rotated toward the first roll 22.

The restricting member 28 is operatively connected to the boss member 53' such that the restricting member 28 is also brought closer to the first roll 22 as the boss member 53' is rotated about the rotational shaft 52' to bring the second roll 24 closer to the first roll 22.

As shown in FIGS. 13 to 15, in the present embodiment, the restricting member 28 is supported by the boss member 53' so as to be shifted toward the first roll 22 about the rotational shaft 51 together with the second roll 24.

When the restricting member 28 is shifted toward the first roll 22, the link rod 29, which is restricted by the restricting member 28 from swinging in the own-weighted swinging direction C1 about the pivot shaft 26, is swung about the pivot shaft 26 toward the virtual vertical plane B2 by an amount in accordance with an amount of shift of the restricting member 28. In this case, the supply plate 27 is swung about the pivot shaft 26 such that the distal end portion thereof is brought closer to the contact point A1 between the first and second rolls 22 and 24.

As described above, in the present embodiment, the restricting member 28 is supported by the boss member 53'.

In the case where the restricting member 28 is provided onto the boss member 53' that is shifted together with the second roll 24 in accordance with degrees of abrasion of the first roll 22 and/or the second roll 24, it is possible to easily realize the configuration in which the restricting member 28 is shifted along with the second roll 24. Therefore, the restricting member 28 can be securely associated with the second roll 24 with no increase of the number of components.

In the present embodiment, the restricting member 28 is provided on a plate portion 523 of the boss member 53', the plate portion 523 being located outside the machine frame 2.

More specific description is given to the restricting member 28.

Figure 16:
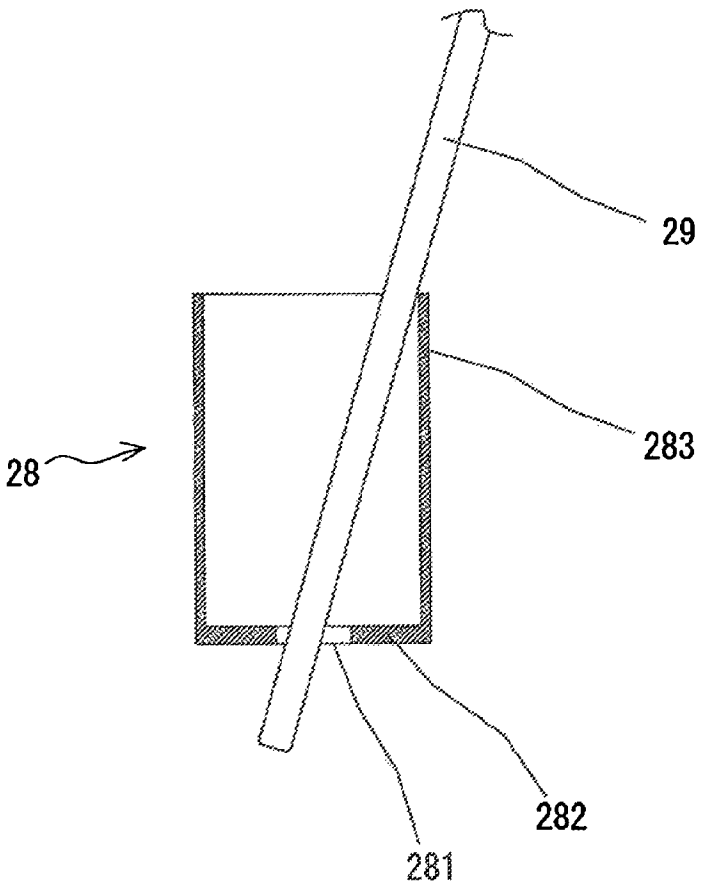
FIG. 16 is an enlarged cross sectional view of XVI portion in FIG. 13.

FIG. 16 is an enlarged cross sectional view of an XVI portion shown in FIG. 13.

The restricting member 28 has a stopper portion that stops the shift of the link rod 29 in the own-weighted swinging direction C1.

In the present embodiment, the restricting member 28 has a lower surface 282 and a pair of flat surfaces, as shown in FIG. 16. The lower surface 282 has an engagement opening 281 in which the distal end portion of the link rod 29 is engaged. The pair of flat surfaces extend substantially in a vertical direction so as to face each other with the engagement opening 281 being interposed therebetween. One of the flat surfaces configures a side surface 283 that serves as the stopper portion for stopping the link rod 29 from swinging in the own-weighted swinging direction C1.

More specifically, the restricting member 28 has a bottom plate and a peripheral wall that extends upward from the peripheral edge of the bottom plate, and is formed into a cylindrical shape with the upper end being opened.

The bottom plate is provided with the engagement opening 281 and configures the lower surface 282.

One side surface of the peripheral wall that is positioned on a side closer to the first roll 22 forms the side surface 283.

In this configuration, an engagement of the distal end portion of the link rod 29 into the engagement opening 281 that is provided in the lower surface 282 of the restricting member 28 keeps the engagement relationship between the link rod 29 and the restricting member 28 (so that the link rod 29 is prevented from being detached from the restricting member 28).

In the restricting member 28, the upper end of the side surface 283 serves as the stopper portion to restrict the link rod 29 from swinging in the own-weighted swinging direction C1, details of which will be described later.

The engagement opening 281 thus provided in the restricting member 28 effectively prevents the restricting member 28 and the link rod 29 from being unintentionally disengaged from each other.

Further, in the configuration, the portion (namely, the engagement opening 281) for retaining the engagement with the link rod 29 is provided separately from the portion (namely, the upper end of the side surface 283) for restricting the link rod 29 from swinging in the own-weighted swinging direction C1. The configuration makes it possible to securely and stably achieve the retainment and the restriction.

In the present embodiment, the restricting member 28 is formed in the cylindrical shape having the bottom plate and the peripheral wall with the opened upper end. However, the present invention is not limited to such a configuration.

Alternatively, the restricting member 28 can be configured by a flat plate member that has only the bottom plate provided therein with the engagement opening 281. In this alternative configuration, serves as the stopper portion is a portion of the inner peripheral surface of the engagement opening 281 that is close to the pivot shaft 26.

The supply plate 27 has the proximal end portion supported by the pivot shaft 26 in a relatively non-rotatable manner with respect thereto and the distal end portion directed toward the contact point A1 between the rolls 22 and 24 in the state where the second roll 24 is made in pressure contact with the first roll 22 by the pressing mechanism 25 as well as the link rod 29 is restricted by the restricting member 28 from swinging in the own-weighted swinging direction C1.

Described below is the flow of hulling operation of the grain huller 1'.

First, the supply shutter 32 is opened the open/close driving unit 33 in a state where the first roll 22, the second roll 24 and the lead roller 35 is driven to rotate by the driving power source. Accordingly, the material grain reserved in the material grain tank 4 falls downward from the supply port 31. The material grain thus fallen downward slides down along a flow path that is formed by the guide plate 34 and the upstream supply plate 36 that are disposed below the supply port 31, and is supplied to the lead roller 35.

By the rotation of the lead roller 35, the material grain supplied to the lead roller 35 is sequentially and quantitatively fed through the upper opening 2*a* to the huller unit 20' inside the machine frame 2 in accordance with the size of the space between the lead roller 35 and the upstream supply plate 36. In a case where it is needed to change supply amount of the material grain to the huller unit 20', the upstream supply plate 36 is rotated about the upstream pivot shaft 37 by use of the adjusting screw 38. Accordingly, the slant angle of the upstream supply plate 36 is changed so that the size of the space between the lead roller 35 and the upstream supply plate 36 is changed.

The material grain supplied from the supply unit 30' slides downward along the surface (facing the second roll 24) of the supply plate 27 so as to be fed to the contact point A1 between the first roll 22 and the second roll 24, to which the distal end portion of the supply plate 27 is directed. The material grain is hulled at the contact point A1, and is discharged from the lower opening 2*b*. The lower opening 2*b* is connected to a blowing sorter (not shown) or the like in which the material grain is sorted into hulled grain particles and chaff.

In the grain huller 1', the second roll 24 is constantly pressed toward the first roll 22 by the pressing mechanism 25, as explained previously. Accordingly, if the first roll 22 and the second roll 24 is abraded due to repeated use so that the outer diameter(s) of the roll(s) is decreased in comparison with the state shown in FIG. 11, the second roll 24 is rotated about the rotational shaft 52' in a direction toward the first roll 24 by the pressing force of the pressing mechanism 25 (FIG. 12). That is, if the first roll 22 and/or the second roll 24 is abraded, the contact point is shifted while the first and second rolls 22, 24 are come in contact with each other at the contact point A1.

When the second roll 24 is moved (that is, when the contact point A1 is shifted from the initial position) due to the abrasion of the first roll 22 and/or the second roll 24, the restricting member 28 is also rotated together with the second roll 24 about the rotational shaft 52' since the restricting member 28 is provided at the boss member 53' that supports the second roll 24.

The link rod 29, which has the proximal end portion supported by the pivot shaft 26 in a relatively non-rotatable manner with respect thereto, has the distal end portion engaged into the engagement opening 281 and an intermediate portion that is extended between the distal end portion and the proximal end portion and is engaged with the stopper portion in the state where the link rod 29 is in such a slant posture as to cause the link rod 29 to swing in the own-weighted swinging direction C1 due to its own weight. When the restricting member 28 is rotated together with the second roll 24 about the rotational shaft 52' toward the first roll 22, the link rod 29 is rotated about the pivot shaft 26 toward the position-fixed shaft 21 by an amount corresponding to an amount of rotation of the restricting member 28. Therefore, the rotation of the pivot shaft 26 about the axis line thereof causes the supply plate 27 to be also rotated about the pivot shaft 26 toward the position-fixed shaft 21 (FIG. 14).

The restricting member 28 thus shifts the position of the link rod 29 around the pivot shaft 26 in accordance with the relative movement of the position-movable shaft 23 with respect to the position-fixed shaft 21. Therefore, the distal end portion of the supply plate 27 can be kept directed toward the contact point A1 between the first roll 22 and the second roll 24 irrespective of the relative movement of the position-movable shaft 23 with respect to the position-fixed shaft 21.

In the state shown in FIG. 14, the link rod 29 is spaced apart from the upper end of the side surface 283 of the restricting member 28 and is in contact with the end of the engagement opening 281, thereby being restricted from swinging in the own-weighted swinging direction C1.

As explained above, in the grain huller 1' according to the present embodiment, the second roll 24 is pressed toward the first roll 22 so that the first and second rolls 22, 24 are come in contact with each other at the contact point A1, and the restricting member 28 that is moved in accordance with the movement of the second roll 24 is operatively connected to the supply plate 27 by way of the link rod 29. Accordingly, the supply plate is rotated by an amount corresponding to the amount of the movement of the second roll 24, so that the distal end portion of the supply plate 27 is automatically directed to the contact point A1.

The configuration makes it possible to automatically adjust the slant posture of the supply plate 27 in accordance with the movement of the second roll 24, without additionally providing a sensor for detecting the outer diameter(s) of the first roll 22 and/or the second roll 24 or a controller for operating based on the result of detection.

In the present embodiment, as shown in FIGS. 13 and 14, the link rod 29, is bent so that the distal end portion is brought closer to the position-fixed shaft 21 around the pivot shaft 26.

More specifically, the link rod 29 has a proximal linear portion and a distal linear portion. The proximal linear portion includes the proximal end portion that is supported by the pivot shaft 26 in a relatively non-rotatable manner with respect thereto. The distal linear portion includes the distal end portion that is engaged with the restricting member 28. The distal linear portion is bent from the proximal linear portion so as to be brought closer to the position-fixed shaft 21.

In other words, the link rod 29 is bent at the portion between the distal end portion and the proximal end portion such that the distal end portion is brought closer to the position-fixed shaft 21 around the pivot shaft 26 with respect to the proximal end portion. More specifically, as shown in FIG. 13, the link rod 29 is bent such that the distal linear portion is located on one side around the pivot shaft 26 (on the side indicated by an arrow C1 toward the position-fixed shaft 21) with reference to a virtual line B1 that is obtained by extending the proximal linear portion.

With the link rod 29 in the shape bent as described above, it is possible to obtain a large angle (almost 90 degrees) with which the distal linear portion inclusive of the distal end portion of the link rod 29 to be engaged with the restricting member 28 is crossed with the direction of the movement of the second roll 24 (the direction of the rotation about the rotational shaft 52').

This configuration can align as much as possible the direction of the movement of the restricting member 28 that rotates together with the second roll 24 about the rotational shaft 52' with the direction of the movement of the distal end portion of the link rod 29 that is rotated about the pivot shaft 26, thereby rotating the supply plate 27 in a more corresponding manner with respect to the movement of the second roll 24. As a result, the distal end portion of the supply plate 27 can follow more accurately the displacement of the contact point A1 between the rolls 22 and 24.

Description has been given to the embodiments of the present invention. However, the present invention is not limited to the embodiments described above, but may be improved, modified, or altered in various ways without departing from the scope of the present invention.

The invention claimed is:

1. A grain huller comprising:

a position-fixed shaft that is rotated around an axis line of the position-fixed shaft by rotational power from a driving power source, a position-movable shaft that is disposed parallel to the position-fixed shaft and is rotated around an axis line of the position-movable shaft by rotational power from the driving power source, a position-movable shaft support member that supports the position-movable shaft in a rotatable manner around the axis line of the position-movable shaft, wherein the position-movable shaft support member is capable of being closer to and spaced away from the position-fixed shaft, a first roll that is supported by the position-fixed shaft in a non-rotatable manner with respect to the position-fixed shaft, a second roll that is supported by the position-movable shaft in a non-rotatable manner with respect to the position-movable shaft, a pressing mechanism that presses the position-movable shaft support member so that the first and second rolls are pressed to each other at a contact point by a predetermined pressure, a pivot shaft that is disposed above and in parallel with the position-fixed shaft and the position-movable shaft, a supply plate that has a proximal end portion supported by the pivot shaft in a non-rotatable manner with respect to the pivot shaft and a distal end portion directed to the contact point so that material grain, which has been fed from above, is naturally flown downward toward the contact point, and a link structure that rotates the pivot shaft around an axis line of the pivot shaft with use of a movement of the position-movable shaft support member to be brought closer to the position-fixed shaft so that a distal end portion of the supply plate is rotated around the pivot shaft in a direction toward the position-fixed shaft in accordance with an amount of the movement of the position-movable shaft support member, wherein the link structure includes:

a fulcrum shaft that is disposed above and in parallel with the position-fixed shaft and the position-movable shaft, a link arm that is supported by the fulcrum shaft in a non-rotatable manner with respect to the fulcrum shaft in a state of having a lower end portion inserted between the position-fixed shaft and the position-movable shaft, a biasing member that operatively biases the link arm, which is not connected to the position-movable shaft support member, such that the lower end portion of the link arm is pressed to a portion of the position-movable shaft support member that faces the position-fixed shaft to cause the link arm to swing about the fulcrum shaft in accordance with the movement of the position-movable shaft support member that comes close to and away from the position-fixed shaft, and a link mechanism that operatively connects the fulcrum shaft and the pivot shaft so that the pivot shaft is rotated about the axis line of the pivot shaft in accordance with the rotation of the fulcrum shaft about the axis line of the fulcrum shaft caused by the link arm, and wherein a slant angle of the supply plate is changed by way of the link arm, the fulcrum shaft, the link mechanism and the pivot shaft in accordance with the movement of position-movable shaft support member that comes close to and away from the position-fixed shaft.

2. The grain huller according to claim 1, wherein the position-movable shaft support member has a proximal end portion supported in a rotatable manner about a rotational shaft that is disposed in parallel with the position-fixed shaft and the position-movable shaft, an arm portion extending radially outward from the proximal end portion with the axis line of the rotational shaft as a reference, a bearing portion provided at the arm portion so as to support the position-movable shaft in a rotatable manner about the axis line of the position-movable shaft, and a connecting portion to which the pressing mechanism is operatively connected, wherein the bearing portion has an outer peripheral surface in a circular arc shape around the axis line of the position-movable shaft, and wherein the lower end portion of the link arm is pressed by the biasing member to a portion of the outer peripheral surface of the bearing portion, the portion facing the position-fixed shaft.

3. The grain huller according to claim 1, wherein the link mechanism includes a first link supported by the fulcrum shaft in a non-rotatable manner with respect to the fulcrum shaft, a second link supported by the pivot shaft in a non-rotatable manner with respect to the pivot shaft, and an intermediate link having a first end portion that is connected to a free end portion of the first link in a rotatable manner with respect to the first link and a second end portion that is connected to a free end portion of the second link in a rotatable manner with respect to the second link.

4. The grain huller according to claim 3, wherein the intermediate link is configured so that its longitudinal length is made adjustable.

5. The grain huller according to claim 1, further comprising:

a material grain tank that is disposed above the first and second rolls, a supply shutter provided at a lower opening of the material grain tank, an upstream supply plate that receives material grain fallen from the lower opening and naturally flow the same downward to the supply plate, and a lead roller capable of adjusting amount of material grain to be supplied to the supply plate in cooperation with the upstream supply plate, wherein the upstream supply plate is supported by an upstream pivot shaft, which is disposed above and in parallel with the pivot shaft, in a non-rotatable manner with respect to the upstream pivot shaft in a state where a slant direction of the upstream supply plate is opposite to that of the supply plate, wherein the grain huller further includes:

an electric motor having an output shaft that extends perpendicularly to the upstream pivot shaft and is driven to rotate about an axis line thereof and forms a screw thread at an outer peripheral surface, a driving member having a screw hole into which the screw thread is engaged and extending in parallel with the upstream pivot shaft, a driven member having a proximal end portion that is supported by the upstream pivot shaft in a non-rotatable manner with respect to the upstream pivot shaft and a free end portion that is provided with an opening allowing the driving member to be engaged thereinto, a slant angle manipulating member capable of being manually operated, and a control unit controlling the electric motor based on an operation signal transmitted from the slant angle manipulating member, wherein the opening has such a shape as to prevent the driving member from being rotated about the axis line of the output shaft when the electric motor is in a driving state, and wherein the control unit actuates the electric motor by an amount according to the operation signal transmitted from the slant angle manipulating member.

6. The grain huller according to claim 5, wherein the control unit has a manual mode of controlling the electric motor based on the operation signal transmitted from the slant angle manipulating member and an automatic mode of automatically controlling the electric motor, and wherein the control unit controls the electric motor to increase or decrease by a predetermined distance the space between the upstream supply plate and the lead roller based on signals transmitted from an upper limit sensor and a lower limit sensor of a tank of a sorter that is provided successively to the grain huller.

* * * * *